US011097756B2

(12) United States Patent
Kubo

(10) Patent No.: US 11,097,756 B2
(45) Date of Patent: Aug. 24, 2021

(54) MOVING BLOCK SIGNALING HEADWAY CALCULATION SYSTEM

(71) Applicants: KABUSHIKI KAISHA TOSHIBA, Minato-ku (JP); TOSHIBA DIGITAL SOLUTIONS CORPORATION, Kawasaki (JP)

(72) Inventor: Hideki Kubo, Fuchu (JP)

(73) Assignees: KABUSHIKI KAISHA TOSHIBA, Minato-ku (JP); TOSHIBA DIGITAL SOLUTIONS CORPORATION, Kawasaki (JP)

( * ) Notice: Subject to any disclaimer, the term of this patent is extended or adjusted under 35 U.S.C. 154(b) by 226 days.

(21) Appl. No.: 16/267,452

(22) Filed: Feb. 5, 2019

(65) Prior Publication Data

US 2019/0168790 A1 Jun. 6, 2019

Related U.S. Application Data

(63) Continuation of application No. PCT/JP2017/015424, filed on Apr. 17, 2017.

(51) Int. Cl.
*B61L 27/00* (2006.01)
*B61L 21/10* (2006.01)

(52) U.S. Cl.
CPC ..... *B61L 27/0027* (2013.01); *B61L 21/10* (2013.01); *B61L 27/0005* (2013.01);
(Continued)

(58) Field of Classification Search
CPC .. B61L 27/0027; B61L 27/10; B61L 27/0005; B61L 27/0038; B61L 27/0077; B61L 2027/005
(Continued)

(56) References Cited

U.S. PATENT DOCUMENTS 8,554,397 B1 * 10/2013 Nishinaga ..... G08G 1/20 701/19
8,744,652 B1 * 6/2014 Nishinaga ..... B60T 8/1705 701/20
(Continued)

FOREIGN PATENT DOCUMENTS

JP 9-150739 A 6/1997
JP 11-198815 A 7/1999
(Continued)

*Primary Examiner* — Yazan A Soofi
(74) *Attorney, Agent, or Firm* — Oblon, McClelland, Maier & Neustadt, L.L.P.

(57) ABSTRACT

According to one embodiment, a moving block signaling headway calculation system recursively executes a process until an interval reaches a limit value. The process includes calculating headway values for a plurality of points on the running section for each interval, extracting a section between adjacent two points, in which an amount of variation in the headway values between the adjacent two points exceeds a threshold value, a section between two points before and after a front point and an end point of a point or a section where a headway value changes from rise to fall, or a section between two points before and after a front point and an end point of a point or a section where a headway value changes from fall to rise, and subdividing the interval in the extracted sections.

5 Claims, 27 Drawing Sheets

(52) U.S. Cl.
CPC ..... *B61L 27/0038* (2013.01); *B61L 27/0077* (2013.01); *B61L 2027/005* (2013.01)

(58) Field of Classification Search
USPC ..... 701/19
See application file for complete search history.

(56) References Cited

U.S. PATENT DOCUMENTS

| | | | | |
|---|---|---|---|---|
| 2015/0232097 | A1* | 8/2015 | Luther | B61L 3/006 701/123 |
| 2017/0057529 | A1* | 3/2017 | Kubo | B61L 27/0022 |
| 2017/0300049 | A1* | 10/2017 | Seally | G06Q 10/047 |

FOREIGN PATENT DOCUMENTS

| | | |
|---|---|---|
| JP | 2010-126075 | 6/2010 |
| JP | 5498688 | 5/2014 |
| JP | 2014-121909 | 7/2014 |
| JP | 5972781 | 8/2016 |

* cited by examiner

| Item | Explanation | Note |
|---|---|---|
| Safety margin distance (preceding train behind) | Safety margin distance from rear end of preceding train toward rear.<br>Used to determine position in which backward-calculated braking curve is started | |
| Safety margin distance (following train ahead) | Safety margin distance secured on start station side from chainage of intersection of preceding train performance curve and backward-calculated braking curve.<br>Point on train performance curve that is returned to starting station side from intersection by safety margin distance (following train ahead) is following train approach point.<br>Not used when following train stops | |
| Signal aspect variation time | Set value of time until operation control is started by calculating backward-calculated braking curve from position of preceding train by following train.<br>Added to headway value when signal headway value is obtained | |
| Driver handling time | Set value of delay time for driver's operation when following train starts.<br>Added when first signal headway value is obtained when following train starts to run through same route as preceding train | Used when following train starts on same route |
| Point switching time | Added when signal headway value is obtained at calculation start point when routes of preceding train and following train are changed from different routes to same route at calculation start point.<br>Added when signal headway is obtained at calculation end point when routes of preceding train and following train are changed from same route to different routes at calculation end point | Used when different routes are changed to same route at start point and when same route is changed to different routes at end point |

F I G. 5

| Route | Nonstop and stop of following train | Calculation start position | Note |
|---|---|---|---|
| Same route | Stop | Point at which preceding train moves toward terminal station from stop position of following train by length of preceding train + margin distance (preceding train behind) | Driver acquisition time is included in added time in the case of at this calculation position |
| | Nonstop | Point at which preceding train moves toward terminal station from station chainage of following train by length of preceding train + safety margin distance (preceding train behind) | |
| Different routes | | Point at which preceding train moves from point at which sections of preceding train and following train become same by length of preceding train + safety margin distance (preceding train behind) | Point switching time is included in added time in the case of at this calculation position |

F I G. 7

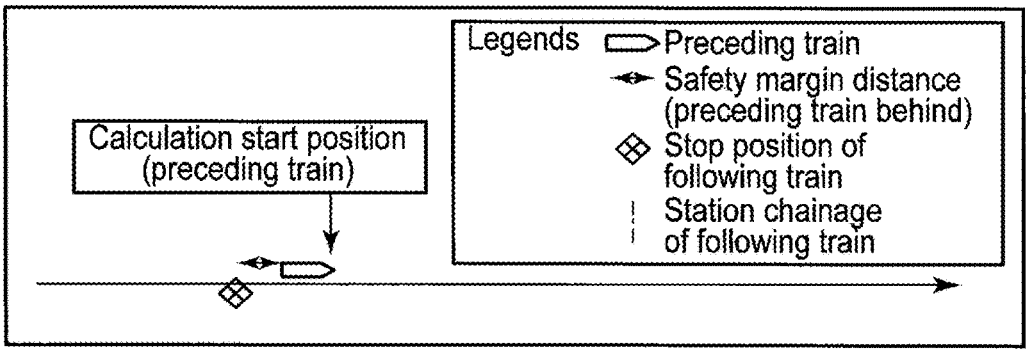

F I G. 8

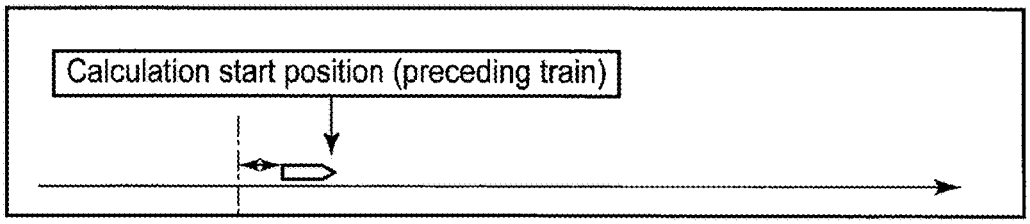

F I G. 9

| Route | Nonstop and stop of preceding train | Calculation start position | Note |
|---|---|---|---|
| Same route | Stop | Station stop position of preceding train | |
| | Nonstop | Station chainage of preceding train | |
| Different routes | | Point at which preceding train moves from point at which sections of preceding train and following train become different by length of preceding train + safety margin distance (preceding train behind).<br>When the point exceeds stop position (in the case of stop) or station chainage (in the case of nonstop) of preceding train, calculation start position is stop position or station chainage | Point switching time is included in added time in the case of at this calculation position |

F I G. 12

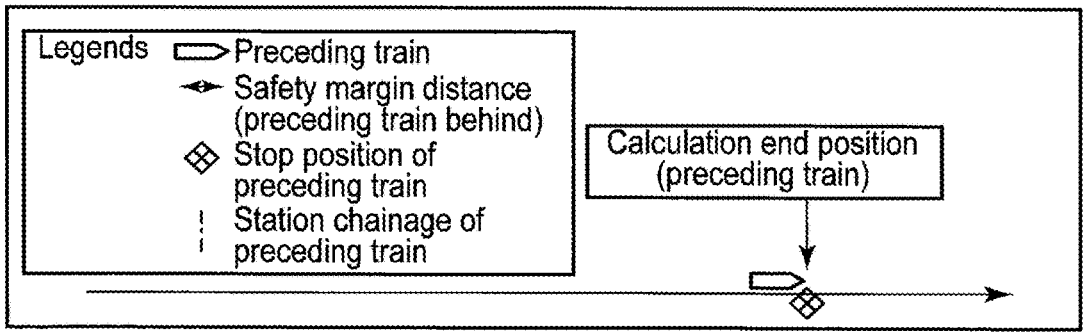

F I G. 13

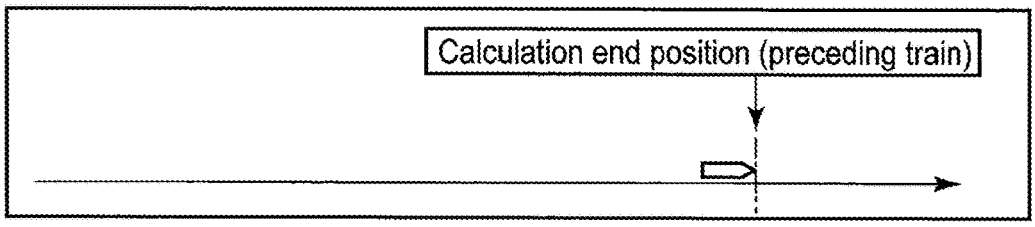

F I G. 14

| Distance | Headway value |
|---|---|
| 5.2 | 4'40"226 |
| 5.3 | 5'01"040 |
| 5.4 | 5'12"118 |
| 5.5 | 5'05"690 |
| 5.6 | 4'56"893 |
| 5.7 | 4'48"700 |
| 5.8 | 4'48"329 |
| 5.9 | 4'32"396 |
| 6.0 | 4'32"088 |
| 6.1 | 5'13"515 |
| 6.2 | 5'47"426 |

| Distance | Headway value | Distance | Headway value |
|---|---|---|---|
| 5.30 | 5'01"040 | 5.40 | 5'12"118 |
| 5.31 | 5'03"845 | 5.41 | 5'13"314 |
| 5.32 | 5'05"458 | 5.42 | 5'12"562 |
| 5.33 | 5'07"996 | 5.43 | 5'12"042 |
| 5.34 | 5'08"336 | 5.44 | 5'11"154 |
| 5.35 | 5'09"475 | 5.45 | 5'10"653 |
| 5.36 | 5'10"484 | 5.46 | 5'09"125 |
| 5.37 | 5'11"600 | 5.47 | 5'08"001 |
| 5.38 | 5'12"155 | 5.48 | 5'07"215 |
| 5.39 | 5'12"920 | 5.49 | 5'06"256 |
| | | 5.50 | 5'05"690 |

(A)

| Distance | Headway value | Distance | Headway value | Distance | Headway value |
|---|---|---|---|---|---|
| 5.80 | 4'48"329 | 5.90 | 4'32"396 | 6.00 | 4'32"088 |
| 5.81 | 4'48"125 | 5.91 | 4'33"914 | 6.01 | 4'35"658 |
| 5.82 | 4'47"652 | 5.92 | 4'32"323 | 6.02 | 4'39"024 |
| 5.83 | 4'46"033 | 5.93 | 4'32"125 | 6.03 | 4'43"333 |
| 5.84 | 4'44"080 | 5.94 | 4'33"466 | 6.04 | 4'47"254 |
| 5.85 | 4'40"962 | 5.95 | 4'32"188 | 6.05 | 4'51"587 |
| 5.86 | 4'35"891 | 5.96 | 4'31"777 | 6.06 | 4'55"154 |
| 5.87 | 4'32"446 | 5.97 | 4'30"123 | 6.07 | 4'59"598 |
| 5.88 | 4'30"290 | 5.98 | 4'29"954 | 6.08 | 5'03"300 |
| 5.89 | 4'31"488 | 5.99 | 4'30"815 | 6.09 | 5'08"150 |
| | | | | 6.10 | 5'13"515 |

(B)

F I G. 35

| Distance | Headway value | Distance | Headway value |
|---|---|---|---|
| 5.400 | 5'12"118 | 5.410 | 5'13"314 |
| 5.401 | 5'12"584 | 5.411 | 5'13"322 |
| 5.402 | 5'12"486 | 5.412 | 5'13"289 |
| 5.403 | 5'12"501 | 5.413 | 5'13"214 |
| 5.404 | 5'12"447 | 5.414 | 5'13"205 |
| 5.405 | 5'12"551 | 5.415 | 5'13"312 |
| 5.406 | 5'12"641 | 5.416 | 5'12"348 |
| 5.407 | 5'12"568 | 5.417 | 5'12"359 |
| 5.408 | 5'13"421 | 5.418 | 5'12"412 |
| 5.409 | 5'13"389 | 5.419 | 5'12"480 |
| | | 5.420 | 5'12"562 |

(A)

| Distance | Headway value | Distance | Headway value |
|---|---|---|---|
| 5.970 | 4'30"123 | 5.980 | 4'29"954 |
| 5.971 | 4'30"253 | 5.981 | 4'29"955 |
| 5.972 | 4'30"515 | 5.982 | 4'30"022 |
| 5.973 | 4'30"510 | 5.983 | 4'30"012 |
| 5.974 | 4'30"508 | 5.984 | 4'30"025 |
| 5.975 | 4'30"510 | 5.985 | 4'30"356 |
| 5.976 | 4'30"508 | 5.986 | 4'30"512 |
| 5.977 | 4'30"508 | 5.987 | 4'30"601 |
| 5.978 | 4'30"510 | 5.988 | 4'30"758 |
| 5.979 | 4'30"420 | 5.989 | 4'30"792 |
| | | 5.990 | 4'30"815 |

(D)

| Distance | Headway value | Distance | Headway value |
|---|---|---|---|
| 5.870 | 4'32"446 | 5.880 | 4'30"290 |
| 5.871 | 4'32"408 | 5.881 | 4'30"158 |
| 5.872 | 4'32"589 | 5.882 | 4'30"385 |
| 5.873 | 4'31"912 | 5.883 | 4'30"588 |
| 5.874 | 4'31"685 | 5.884 | 4'30"966 |
| 5.875 | 4'31"426 | 5.885 | 4'30"994 |
| 5.876 | 4'31"330 | 5.886 | 4'31"141 |
| 5.877 | 4'31"100 | 5.887 | 4'31"200 |
| 5.878 | 4'31"025 | 5.888 | 4'31"360 |
| 5.879 | 4'30"850 | 5.889 | 4'31"455 |
| | | 5.890 | 4'31"488 |

(B)

| Distance | Headway value | Distance | Headway value | Distance | Headway value | Distance | Headway value | Distance | Headway value |
|---|---|---|---|---|---|---|---|---|---|
| 5.900 | 4'32"396 | 5.910 | 4'33"914 | 5.920 | 4'32"323 | 5.930 | 4'32"125 | 5.940 | 4'33"466 |
| 5.901 | 4'32"420 | 5.911 | 4'33"955 | 5.921 | 4'32"333 | 5.931 | 4'32"125 | 5.941 | 4'33"512 |
| 5.902 | 4'32"568 | 5.912 | 4'33"935 | 5.922 | 4'32"512 | 5.932 | 4'32"125 | 5.942 | 4'33"355 |
| 5.903 | 4'32"591 | 5.913 | 4'32"790 | 5.923 | 4'32"254 | 5.933 | 4'32"120 | 5.943 | 4'33"354 |
| 5.904 | 4'32"670 | 5.914 | 4'32"622 | 5.924 | 4'32"355 | 5.934 | 4'32"412 | 5.944 | 4'33"252 |
| 5.905 | 4'32"789 | 5.915 | 4'32"622 | 5.925 | 4'32"336 | 5.935 | 4'32"455 | 5.945 | 4'33"220 |
| 5.906 | 4'32"813 | 5.916 | 4'33"025 | 5.926 | 4'32"852 | 5.936 | 4'32"355 | 5.946 | 4'33"189 |
| 5.907 | 4'33"045 | 5.917 | 4'33"506 | 5.927 | 4'33"125 | 5.937 | 4'32"221 | 5.947 | 4'32"985 |
| 5.908 | 4'33"247 | 5.918 | 4'33"410 | 5.928 | 4'32"445 | 5.938 | 4'33"200 | 5.948 | 4'32"522 |
| 5.909 | 4'33"611 | 5.919 | 4'32"852 | 5.929 | 4'32"120 | 5.939 | 4'33"322 | 5.949 | 4'32"301 |
| | | | | | | | | 5.950 | 4'32"188 |

(C)

FIG. 37

| Distance | Headway value | Distance | Headway value | Distance | Headway value | Distance | Headway value | Distance | Headway value | Distance | Headway value |
|---|---|---|---|---|---|---|---|---|---|---|---|
| 5.200 | 4'40"226 | 5.415 | 5'13"312 | 5.873 | 4'31"912 | 5.908 | 4'33"247 | 5.934 | 4'32"412 | 5.978 | 4'30"510 |
| 5.300 | 5'01"040 | 5.416 | 5'12"348 | 5.874 | 4'31"685 | 5.909 | 4'33"611 | 5.935 | 4'32"455 | 5.979 | 4'30"420 |
| 5.310 | 5'03"845 | 5.417 | 5'12"359 | 5.875 | 4'31"426 | 5.910 | 4'33"914 | 5.936 | 4'32"355 | 5.980 | 4'29"954 |
| 5.320 | 5'05"458 | 5.418 | 5'12"412 | 5.876 | 4'31"330 | 5.911 | 4'33"955 | 5.937 | 4'32"221 | 5.981 | 4'29"955 |
| 5.330 | 5'07"996 | 5.419 | 5'12"480 | 5.877 | 4'31"100 | 5.912 | 4'33"935 | 5.938 | 4'33"200 | 5.982 | 4'30"022 |
| 5.340 | 5'08"336 | 5.420 | 5'12"562 | 5.878 | 4'31"025 | 5.913 | 4'32"790 | 5.939 | 4'33"322 | 5.983 | 4'30"012 |
| 5.350 | 5'09"475 | 5.430 | 5'12"042 | 5.879 | 4'30"850 | 5.914 | 4'33"622 | 5.940 | 4'33"466 | 5.984 | 4'30"025 |
| 5.360 | 5'10"484 | 5.440 | 5'11"154 | 5.880 | 4'30"290 | 5.915 | 4'32"622 | 5.941 | 4'33"512 | 5.985 | 4'30"356 |
| 5.370 | 5'11"600 | 5.450 | 5'10"653 | 5.881 | 4'30"158 | 5.916 | 4'33"025 | 5.942 | 4'33"355 | 5.986 | 4'30"512 |
| 5.380 | 5'12"155 | 5.460 | 5'09"125 | 5.882 | 4'30"385 | 5.917 | 4'33"506 | 5.943 | 4'33"354 | 5.987 | 4'30"601 |
| 5.390 | 5'12"920 | 5.470 | 5'08"001 | 5.883 | 4'30"588 | 5.918 | 4'33"410 | 5.944 | 4'33"252 | 5.988 | 4'30"758 |
| 5.400 | 5'12"118 | 5.480 | 5'07"215 | 5.884 | 4'30"966 | 5.919 | 4'32"852 | 5.945 | 4'33"220 | 5.989 | 4'30"792 |
| 5.401 | 5'12"584 | 5.490 | 5'06"256 | 5.885 | 4'30"994 | 5.920 | 4'32"323 | 5.946 | 4'33"189 | 5.990 | 4'30"815 |
| 5.402 | 5'12"486 | 5.500 | 5'05"690 | 5.886 | 4'31"141 | 5.921 | 4'32"333 | 5.947 | 4'32"985 | 6.000 | 4'32"088 |
| 5.403 | 5'12"501 | 5.600 | 4'56"893 | 5.887 | 4'31"200 | 5.922 | 4'32"512 | 5.948 | 4'32"522 | 6.010 | 4'35"658 |
| 5.404 | 5'12"447 | 5.700 | 4'48"700 | 5.888 | 4'31"360 | 5.923 | 4'32"254 | 5.949 | 4'32"301 | 6.020 | 4'39"024 |
| 5.405 | 5'12"551 | 5.800 | 4'48"329 | 5.889 | 4'31"455 | 5.924 | 4'33"355 | 5.950 | 4'32"188 | 6.030 | 4'43"333 |
| 5.406 | 5'12"641 | 5.810 | 4'48"125 | 5.890 | 4'31"488 | 5.925 | 4'33"336 | 5.960 | 4'31"777 | 6.040 | 4'47"254 |
| 5.407 | 5'12"568 | 5.820 | 4'47"652 | 5.900 | 4'32"386 | 5.926 | 4'32"852 | 5.970 | 4'30"123 | 6.050 | 4'51"587 |
| 5.408 | 5'13"421 | 5.830 | 4'46"033 | 5.901 | 4'32"420 | 5.927 | 4'33"125 | 5.971 | 4'30"253 | 6.060 | 4'55"154 |
| 5.409 | 5'13"389 | 5.840 | 4'44"080 | 5.902 | 4'32"568 | 5.928 | 4'32"445 | 5.972 | 4'30"515 | 6.070 | 4'59"598 |
| 5.410 | 5'13"314 | 5.850 | 4'40"962 | 5.903 | 4'32"591 | 5.929 | 4'32"120 | 5.973 | 4'30"510 | 6.080 | 5'03"300 |
| 5.411 | 5'13"322 | 5.860 | 4'35"891 | 5.904 | 4'32"670 | 5.930 | 4'32"125 | 5.974 | 4'30"508 | 6.090 | 5'08"150 |
| 5.412 | 5'13"289 | 5.870 | 4'32"446 | 5.905 | 4'32"789 | 5.931 | 4'32"125 | 5.975 | 4'30"510 | 6.100 | 5'13"515 |
| 5.413 | 5'13"214 | 5.871 | 4'32"408 | 5.906 | 4'32"813 | 5.932 | 4'32"125 | 5.976 | 4'30"508 | 6.200 | 5'47"426 |
| 5.414 | 5'13"205 | 5.872 | 4'32"589 | 5.907 | 4'33"045 | 5.933 | 4'32"120 | 5.977 | 4'30"508 | | |

FIG. 38

List of headway values

| Preceding train chainage | Preceding train time | Preceding train position chainage | | Calculation headway value |
|---|---|---|---|---|
| Following train chainage | Following train time | Following train speed | Brake distance | Signal headway value |
| 0.344 | 0:43.677 | | 0.290 | 0:19.096 |
| 0.201 | 0:24.581 | 27.000 | 89 | 0.19.096 |

MOVING BLOCK SIGNALING HEADWAY CALCULATION SYSTEM

CROSS-REFERENCE TO RELATED APPLICATIONS

This application is a Continuation Application of PCT Application No. PCT/JP2017/015424, filed Apr. 17, 2017, the entire contents of which are incorporated herein by reference.

FIELD

Embodiments described herein relate generally to a moving block signaling headway calculation system.

BACKGROUND

An operation interval between a preceding train and its following train is called headway, and a time interval in which the trains can safely run without colliding with each other is called a headway value (time).

In conventional signal systems, trains were controlled for each section with a fixed distance which is called a block. To evaluate whether a plurality of trains can safely run, a headway value had only to be evaluated at the end of a block (where a signal is set up). However, the signal systems have recently been advanced and do not require a block. A non-block operation control type signal system (moving block signal system) has been developed which controls an own train calculating a distance between the own train and another train via a position detection device on each of the trains and a communication device on the ground. Therefore, the evaluation of the headway value is also required to be adapted to the moving block signal system.

Since the moving block signal systems have no concept of a block, a point at which headway should be evaluated is not clear, but headway should be evaluated at every point between all stations for trains that run. Specifically, a headway value is calculated continuously at a distance point in a distance direction between stations to draw a headway distribution curve between the stations, and it is necessary to evaluate at which point close to the distance point the headway value becomes large to allow the preceding and following two trains to come close to each other.

The headway value at a certain point is obtained by calculating a brake curve of the following train backward from its stop position (calculation start point) and brake time to an intersection of the brake curve and a train performance curve (distance-speed curve). As the theory for efficient train operation (Japan), however, deceleration and elapsed time are calculated by grading per second, and the speed and the brake distance are accumulated every second. The amount of calculation is large even at one point and time is required to calculate a headway value.

In the moving block signal systems, headway values are calculated at regular intervals in order to obtain a headway distribution curve. To calculate the headway values, the following two methods can be considered: (1) calculation every fixed time and (2) calculation every fixed distance. Of these, here, a method of calculation every fixed distance will be noted.

The headway distribution curve can be obtained by setting a fixed distance (computation granularity) freely and repeating the headway calculation every fixed distance, and its accuracy is proportionate to the computation granularity. When the fixed distance (computation granularity) is set small to increase the accuracy of the distribution curve, the amount of calculation increases to cause a problem in which the processing is not completed within a reasonable time. One of conventional headway curve drawing devices is designed to create a new time curve by adding a safety margin distance and a brake distance to the original time curve to obtain a point of contact between the new time curve and the time curve of the following train and thus to obtain the largest headway value and not to obtain continuous headway values.

There are no devices to calculate headway values continuously for every fixed interval in a running section of trains.

BRIEF DESCRIPTION OF THE DRAWINGS

FIG. 5 is a diagram showing a list of variables used in moving block signaling headway calculation in the moving block signaling headway calculation system according to the embodiment.

FIG. 7 is a diagram showing rules to determine a headway value calculation start position with respect to routes and stop/nonstop in the moving block signaling headway calculation system according to the embodiment.

FIG. 8 is a diagram showing a calculation start position in a case where a following train stops and starts when it runs through the same route as its preceding train, which is determined in the moving block signaling headway calculation system according to the embodiment.

FIG. 9 is a diagram showing a calculation start position in a case where a preceding train does not stop when it runs through the same route as its following train, which is determined in the moving block signaling headway calculation system according to the embodiment.

FIG. 12 is a diagram showing rules to determine a headway value calculation end position with respect to routes and stop/nonstop in the moving block signaling headway calculation system according to the embodiment.

FIG. 13 is a diagram showing a calculation end position in a case where a preceding train stops when it runs through the same route as its following train, which is determined in the moving block signaling headway calculation system according to the embodiment.

FIG. 14 is a diagram showing a calculation end position in a case where a preceding train does not stop when it runs through the same route as its following train, which is determined in the moving block signaling headway calculation system according to the embodiment.

FIG. 35 is a diagram showing an example of headway calculation in a section in which the resolution shown in FIG. 34 should be increased.

FIG. 37 is a diagram showing an example of headway calculation in a section in which the resolution shown in FIG. 36 should be increased.

FIG. 38 is a diagram showing an example of all headway values calculated by the moving block signaling headway calculation system according to the embodiment.

DETAILED DESCRIPTION

Various embodiments will be described hereinafter with reference to the accompanying drawings.

In general, according to one embodiment, a moving block signaling headway calculation system calculates a headway value in a running section of a train whose operation is controlled irrespective of blockage. The system includes an acquisition processor and a headway value calculator. The acquisition processor acquires calculation distance interval data, refinement granularity data and headway value variation amount threshold value data. The calculation distance interval data represents a reference value of an interval between points at which a headway value is to be calculated. The refinement granularity data represents a limit value with which the interval is allowed to be subdivided. The headway value variation amount threshold value data represents a threshold value of an amount of variation in headway value between adjacent two points. The headway value calculator obtains a headway value distribution curve in the running section. The headway value calculator sets the reference value represented by the calculation distance interval data to the interval as an initial value. The headway value calculator recursively executes a process until the interval reaches a limit value indicated by the refinement granularity data. The process includes calculating headway values for a plurality of points on the running section for each interval; extracting a section between adjacent two points, in which an amount of variation in the headway values between the adjacent two points exceeds the threshold value represented by the headway value variation amount threshold value data, a section between two points before and after a front point and an end point of a point or a section where a headway value changes from rise to fall, or a section between two points before and after a front point and an end point of a point or a section where a headway value changes from fall to rise; and subdividing the interval in the extracted sections to calculate the headway value.

Figure 1:
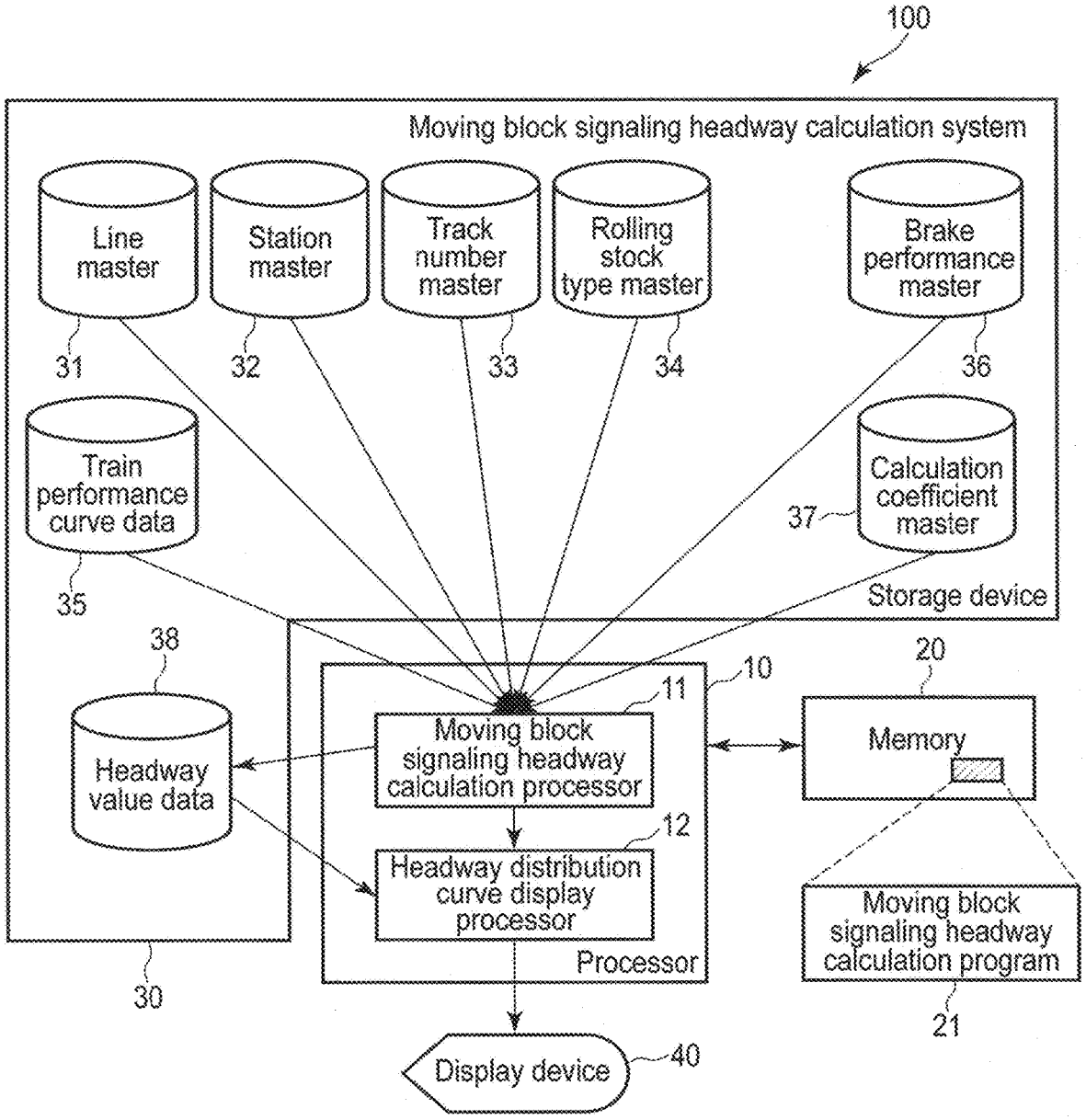
FIG. 1 is a diagram showing an example of a configuration of a moving block signaling headway calculation system according to an embodiment.

FIG. 1 is a diagram showing an example of a configuration of a moving block signaling headway calculation system 100 according to an embodiment.

As shown in FIG. 1, the moving block signaling headway calculation system 100 is configured by a processor 10, a memory 20, a storage device 30 and a display device 40. The moving block signaling headway calculation system 100 achieves each function unit of a moving block signaling headway calculation processor 11 and a headway distribution curve display processor 12 by executing a moving block signaling headway calculation program 21 stored in the memory 20 by the processor 10. Each function unit may be achieved by not software but hardware such as a dedicated electronic circuit.

Figure 2:
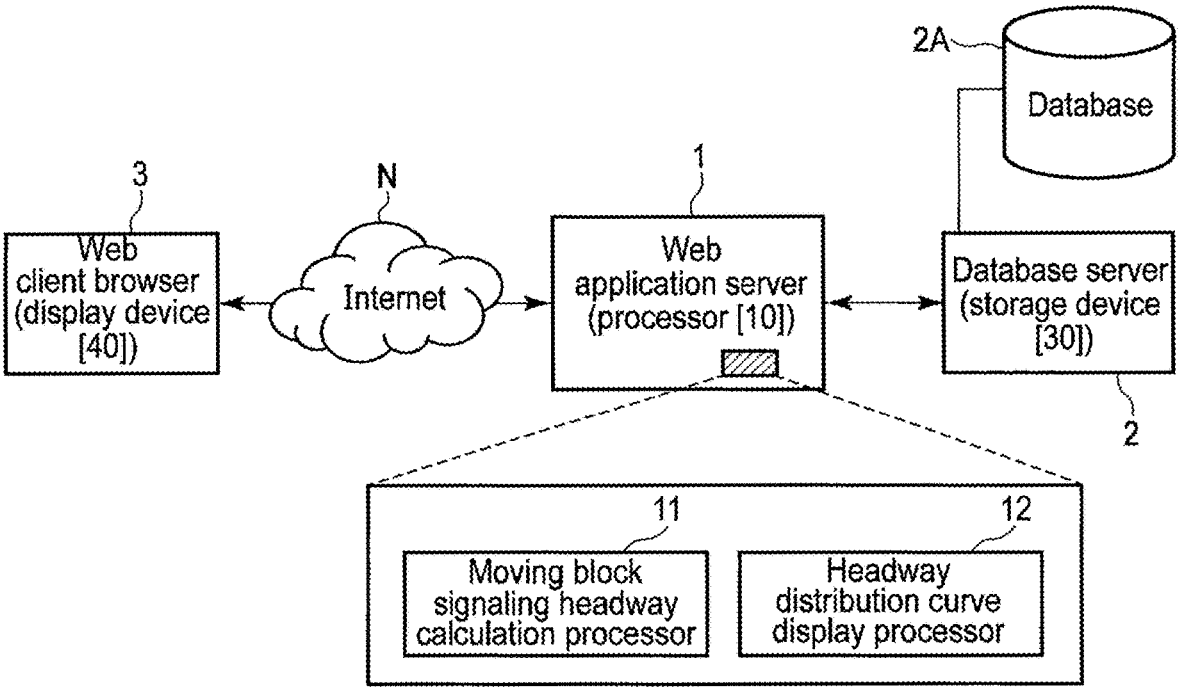
FIG. 2 is a diagram showing an example where the moving block signaling headway calculation system according to the embodiment is configured by a plurality of computers.

The moving block signaling headway calculation system 100 may also be configured by a single computer and, as shown in FIG. 2, configured by a plurality of computers (a Web application server 1, a database server 2 and a Web client browser 3). For example, upon receipt of a request from the client browser 3 via the Internet N, the Web application server 1 may perform various processes using data stored in the database server 2 (database 2A), a variable received from the Web client browser 3, and the like and return the results to the Web client browser 3. In other words, the role of the processor 10 shown in FIG. 1 may be responsible for the Web application server 1, the role of the storage device 30 shown in FIG. 1 may be responsible for the database server 2, and the role of the display device 40 shown in FIG. 1 may be responsible for the Web client browser 3. The Web application server 1 can accept requests from a plurality of Web client browsers 3 and perform various processes in parallel in response to the requests.

The storage device 30 stores a line master 31, a station master 32, a track number master 33 and a rolling stock type master 34. The storage device 30 also stores train performance curve data (distance-speed curve data and distance-time curve data) 35 calculated by a known train performance curve system, etc. Furthermore, the storage device 30 stores a brake performance master 36 and a calculation coefficient master (coefficient master for calculation by the theory for efficient train operation) 37.

The moving block signaling headway calculation processor 11 calculates a headway value suitable for a moving block signal system using the various masters and data stored in the storage device 30. The headway value data (distance headway value data and distance-brake distance data) 38 calculated by the moving block signaling headway calculation processor 11 is stored in the storage device 30.

The headway distribution curve display processor 12 reads the headway value data 38 from the storage device 30 and displays a headway distribution curve, a brake distance curve, etc., on the display device 40.

Here, in order to assist the understanding of the moving block signaling headway calculation system 100 of the present embodiment, the problems associated with the evaluation of a headway value in the case of a moving block signal system will be organized.

In conventional signal systems, there are sections called blocks between stations, and there can be only one train within each of the sections. Thus, the number of trains that can exist between stations depends upon the number of blocks and so does the interval between trains. To shorten the train headway, the number of blocks needs to be changed. If the number of blocks is increased, a number of trains can run, but a number of signals should be set, which becomes costly. Moreover, each block cannot be set shorter than the longest train that runs in the block. As a result, a block section will become longer than the train. In other words, to shorten the train headway, there are two limits of a cost limit and a physical limit.

On the other hand, a moving block signal system which does not rely on a block has recently appeared. This is a signal system called communication-based train control (CBTC) capable of controlling one's own train while comparing position information obtained from a position detection device on the one's own train and position information of another train obtained from a communication device on the ground. In the moving block signal system, the headway can be shortened to the utmost limit because a distance between one's own train and another train is constantly calculated. The headway values at all distance points have not been so far evaluated, paying attention to the lengths of a preceding train and its following train, at certain distance intervals in all station-to-station sections, because the amount of calculation becomes large. If the new signal system is introduced and tries evaluating how much the headway can be shortened, the headway has to be evaluated all over the areas between the stations.

Figure 3:
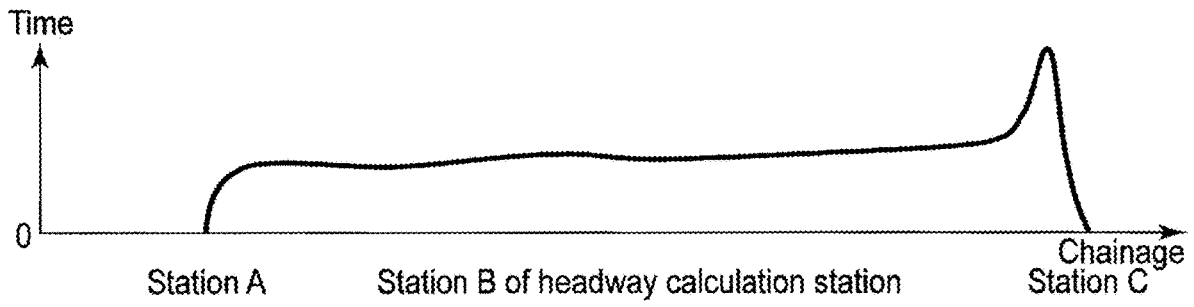
FIG. 3 is a diagram showing an example of a headway distribution curve.

Assume that a train runs from station A to station C. It is necessary that a headway value at a certain distance point is calculated continuously in a distance direction to draw a headway distribution curve from station A to station C as shown in FIG. 3. Further, it is necessary to evaluate at which distance point the headway value is so large that the two preceding and following trains cannot be brought close to each other.

Figure 4:
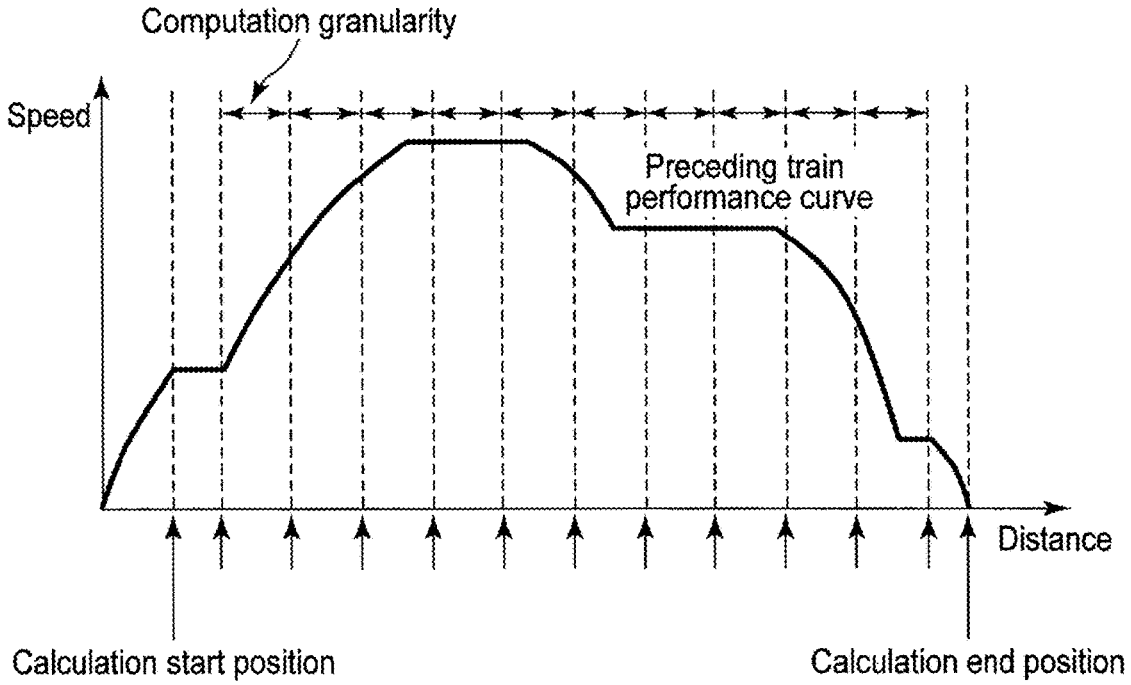
FIG. 4 is a diagram illustrating an idea of calculating a headway value in the moving block signaling headway calculation system.

As shown in FIG. 4, the headway distribution curve can be obtained by setting a fixed distance (computation granularity) selectively and repeating headway calculation every fixed distance, and its accuracy is proportionate to the computation granularity. The following is a basic way of thinking. If a headway value between the preceding train and its following train is obtained when the level of detail of calculation in the distance direction is, e.g., 1 m, an almost accurate headway distribution curve can be obtained.

If, however, headway calculation is performed at intervals of, e.g., 1 m to increase the accuracy of the distribution curve, it needs to be done 1000 times in a section of, e.g., 1 km, and the number of times of calculation increases, which causes a problem that the calculation is not terminated in an appropriate time. This is a problem associated with the evaluation of a headway value in the case of the moving block signal system.

The headway value hardly varies as long as the preceding train and its following train run at the same speed if there are no variable elements such as a gradient for easy understanding. At a point where the preceding train decelerates, a difference in speed is caused to increase the headway value. The speed and brake distance vary with a change in running resistance such as a gradient and a curve, as does the headway value. In general urban transport, however, the headway value does not vary extremely with the distance of a train length. It is considered that the headway value varies extremely in the case of mountain railways in the mountain area and, if the headway value is calculated at intervals of the train length, the variation in the headway value can be acquired. The train length is a distance that is an index as computation granularity to see the headway distribution.

Versatile evaluation of headway values is not satisfied unless the calculation interval is varied with a train running route. Since the train performance curve is calculated in consideration of the train length, the headway values can be evaluated versatilely if the headway value calculation interval can be varied with the train length.

The moving block signaling headway calculation system 100 of the present embodiment is a system which calculates headway values continuously for the running section of a train to obtain the distribution of the headway values. To fulfil this function to simply calculate the headway values at regular intervals, the number of times of calculation is increased and the processing time is lengthened. On the other hand, the moving block signaling headway calculation system 100 employs its unique headway value calculation method capable of excluding a section in which no calculation is necessary to obtain a high-accuracy headway distribution curve with a small number of times of calculation. The following is a detailed description of the headway value calculation method.

In the moving block signaling headway calculation of the moving block signaling headway calculation system 100 (calculation of headway values in the moving block signal system), there are no existing signal positions or section boundaries to be used for the calculation. Instead, the headway value calculation is performed by determining a position of the preceding train (calculation position) at computation granularity intervals within the calculation range, calculating a backward-calculated braking curve (brake curve calculated back in time), and calculating an approach point of the subsequent train. Assume that the train performance curve data (speed to distance=distance-speed curve data, time to distance=distance-time curve data) is determined by another train performance curve calculation system.

FIG. 5 shows a list of set values and data (variables) used in the moving block signaling headway calculation in the moving block signaling headway calculation system 100. As shown in FIG. 5, in the moving block signaling headway calculation in the moving block signaling headway calculation system 100, the variables such as "safety margin distance (preceding train behind)", "safety margin distance (following train ahead)", "signal aspect variation time", "driver handling time" and "point switching time" are used. Assume that these set values and data are prepared and stored in the storage device 30.

Below is a description of the premise of the moving block signaling headway calculation and setting of the calculation conditions in the moving block signaling headway calculation system 100.

Figure 6:
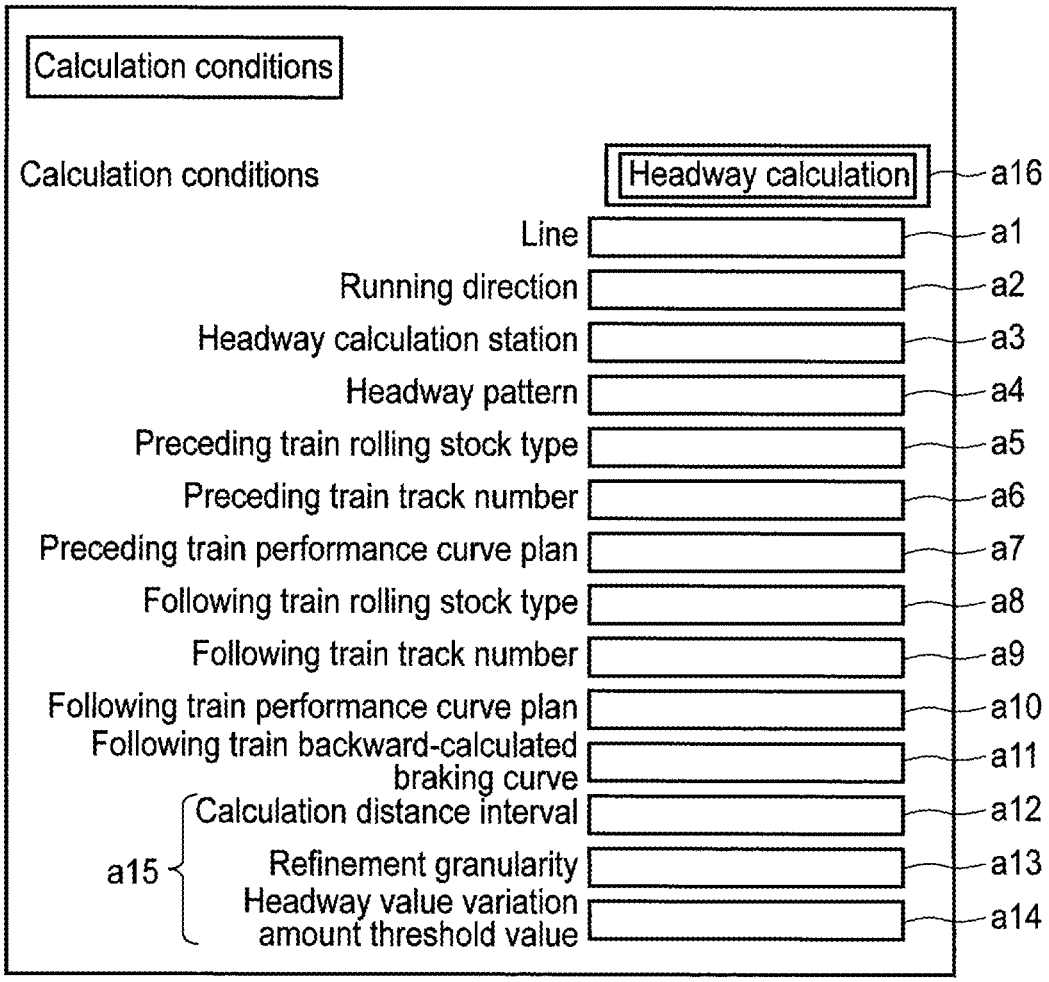
FIG. 6 is a diagram showing an example of a calculation instruction screen capable of setting calculation conditions presented by the moving block signaling headway calculation system according to the embodiment.

In the moving block signaling headway calculation system 100, when a headway distribution curve is obtained in the moving block signal system, moving block signaling headway calculation is performed by presenting a calculation instruction screen capable of setting, e.g., calculation conditions as shown in FIG. 6 and inputting various conditions required for the calculation. Assume here that the moving block signaling headway calculation processor 11 has a function of presenting the calculation instruction screen.

For example, a line is selected (a1) and an up or down running direction is selected (a2) in order to select a section to be calculated. Furthermore, a headway calculation station in the section is selected (a3), and a headway pattern (a4) that is represented by the combination of departure, arrival and nonstop, such as arrival/arrival (which means arrival of the preceding train and arrival of the following train) and departure/departure (which means departure of the preceding train and departure of the following train). Selecting the headway calculation station and the headway pattern, it is determined which section is calculated, such as a section between the headway calculation station and the next station, a section between the headway calculation station and the last station, and a section between the next and last stations including the headway calculation station.

Furthermore, at a station where headway values are to be calculated, a preceding train rolling stock type (a5), a preceding train track number (a6), a preceding train performance curve (a7), following train rolling stock type (a8), following train track number (a9), following train performance curve (a10), and a following train brake notch (all) for use in the calculation are selected. Since the preceding train rolling stock type and the following train rolling stock type are selected, the train length of the preceding train and that of the following train can also be obtained.

The moving block signaling headway calculation system 100 also receives the settings of a calculation distance interval (a12), refinement granularity (a13) and a headway value variation amount threshold value (a14). The calculation distance interval is a reference value of an interval between points at which a headway value should be calculated. The refinement granularity is a limit value to allow an interval to be subdivided. The headway value variation amount threshold value is a threshold value of an amount of variation in headway value between adjacent two points. Of the values (variables) set on the calculation instruction screen, the three variables indicated by symbol a15 are variables unique to the moving block signaling headway calculation system 100 of the present embodiment, which are set to decrease the amount of calculation and increase the speed of calculation. Note that there is resolution, described later, as a variable unique to the moving block signaling headway calculation system 100 of the present embodiment and the resolution can be set on the calculation instruction screen. Assume here that the resolution is a default fixed value in the moving block signaling headway calculation system 100.

In the moving block signaling headway calculation system 100, in more detail, when a headway calculation button a16 is operated, the moving block signaling headway calculation processor 11 performs moving block signaling headway calculation using the variables (and various masters and data stored in the storage device 30) set on the calculation instruction screen.

The moving block signaling headway calculation processor 11 first determines a headway value calculation start position and a headway value calculation end position within a section in which a preceding train and its following train run.

Firstly, the moving block signaling headway calculation processor 11 determines a headway value calculation start position with respect to routes and stop/nonstop as shown in FIG. 7. The rules to determine the headway value calculation start position will be described in detail with reference to FIG. 8, FIG. 9 and FIG. 10.

Figure 10:
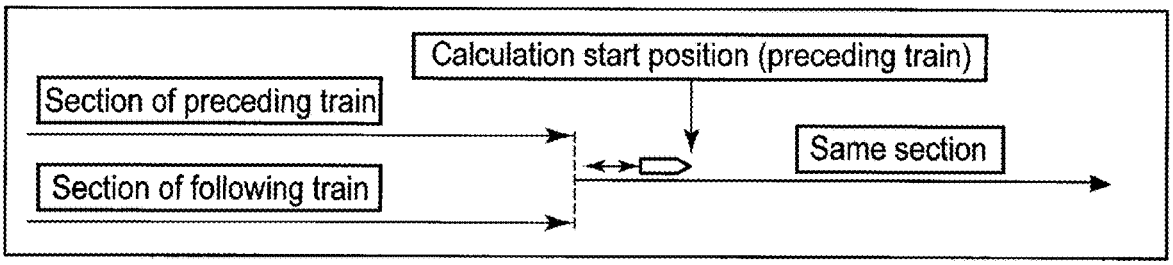
FIG. 10 is a diagram showing a calculation start position in a case where a preceding train and its following train run through different routes, which is determined in the moving block signaling headway calculation system according to the embodiment.

FIG. 8 shows a calculation start position in a case a following train stops and starts when it runs through the same route as its preceding train. FIG. 9 shows a calculation start position in a case where a preceding train does not stop when it runs through the same route as its following train. FIG. 10 shows a calculation start position in a case where a preceding train and its following train run through different routes.

When a headway pattern is "departure/arrival", in the conventional signal system, a headway value was calculated for only one signal; on the other hand, in the moving block signaling headway calculation, a headway value is calculated during which a condition is satisfied for each computation granularity because there are no signals. A plurality of calculation results can thus be produced.

Figure 11:
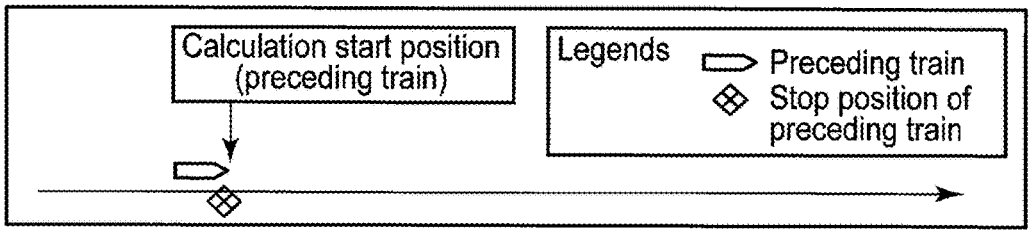
FIG. 11 is a diagram showing a calculation start position in a case where a headway pattern is "departure/arrival" in the moving block signaling headway calculation system according to the embodiment.

FIG. 11 shows a calculation start position in a case where a headway pattern is "departure/arrival". Like in the case of the conventional signal system, in the case of "departure/arrival", a headway value is calculated only for the same route. When the headway pattern is "departure/arrival", the headway value calculation start position is defined as a preceding train stop position.

Secondly, the moving block signaling headway calculation processor 11 determines a headway value calculation end position with respect to routes and stop/nonstop as shown in FIG. 12. The rules to determine the headway value calculation end position will be described in detail with reference to FIG. 13, FIG. 14, FIG. 15, FIG. 16, FIG. 17, FIG. 18 and FIG. 19.

FIG. 13 shows a calculation end position in a case where a preceding train stops when it runs through the same route as its following train. FIG. 14 shows a calculation end position in a case where a preceding train does not stop when it runs through the same route as its following train.

Figure 15:
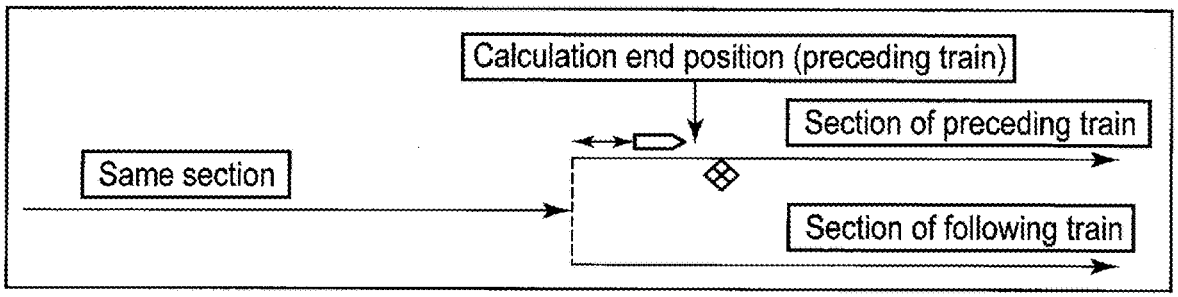
FIG. 15 is a diagram showing a calculation end position in a case where a preceding train and its following train run through different routes and a sum of train length and safety margin distance (preceding train behind) does not exceed a stop position, which is determined in the moving block signaling headway calculation system according to the embodiment.
Figure 16:
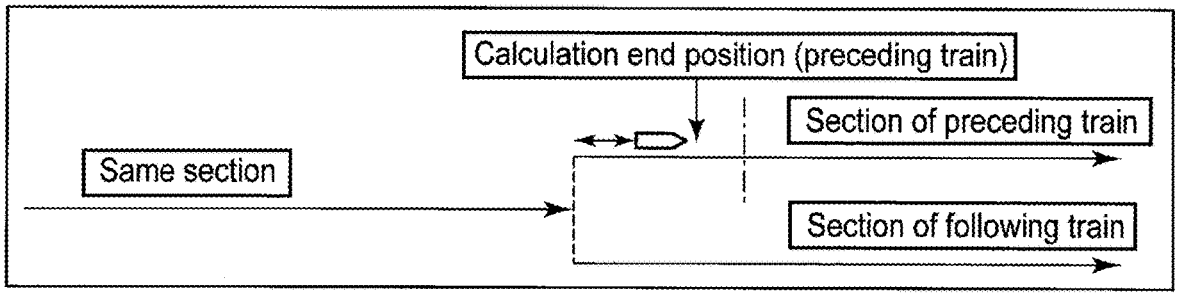
FIG. 16 is a diagram showing a calculation end position in a case where a preceding train and its following train run through different routes and a sum of train length and safety margin distance (preceding train behind) does not exceed a station chainage, which is determined in the moving block signaling headway calculation system according to the embodiment.
Figure 17:
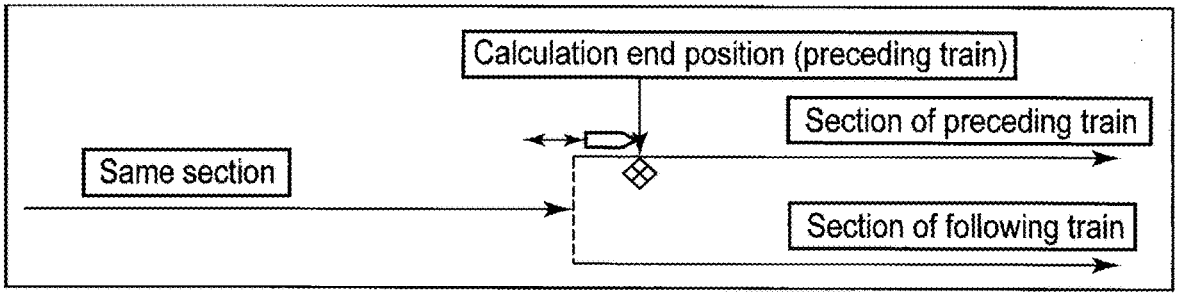
FIG. 17 is a diagram showing a case where a preceding train and its following train run through different routes and a sum of train length and safety margin distance (preceding train behind) exceeds a stop position and thus the stop position corresponds to a calculation end position, which is determined in the moving block signaling headway calculation system according to the embodiment.
Figure 18:
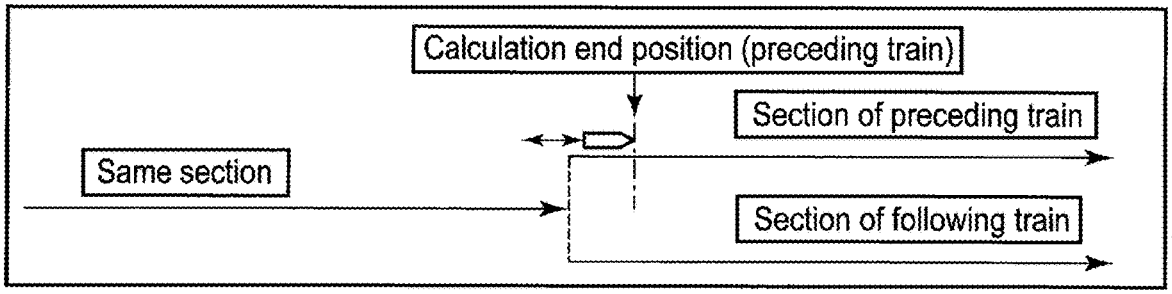
FIG. 18 is a diagram showing a case where a preceding train and its following train run through different routes and a sum of train length and safety margin distance (preceding train behind) exceeds a station chainage and thus the station chainage corresponds to a calculation end position, which is determined in the moving block signaling headway calculation system according to the embodiment.

FIG. 15 shows a calculation end position in a case where a preceding train and its following train run through different routes and a sum of train length and safety margin distance (preceding train behind) does not exceed a stop position. FIG. 16 shows a calculation end position in a case where a preceding train and its following train run through different routes and a sum of train length and safety margin distance (preceding train behind) does not exceed a station chainage. FIG. 17 shows a case where a preceding train and its following train run through different routes and a sum of train length and safety margin distance (preceding train behind) exceeds a stop position and thus the stop position corresponds to a calculation end position. FIG. 18 shows a case where a preceding train and its following train run through different routes and a sum of train length and safety margin distance (preceding train behind) exceeds a station chainage and thus the station chainage corresponds to a calculation end position.

Figure 19:
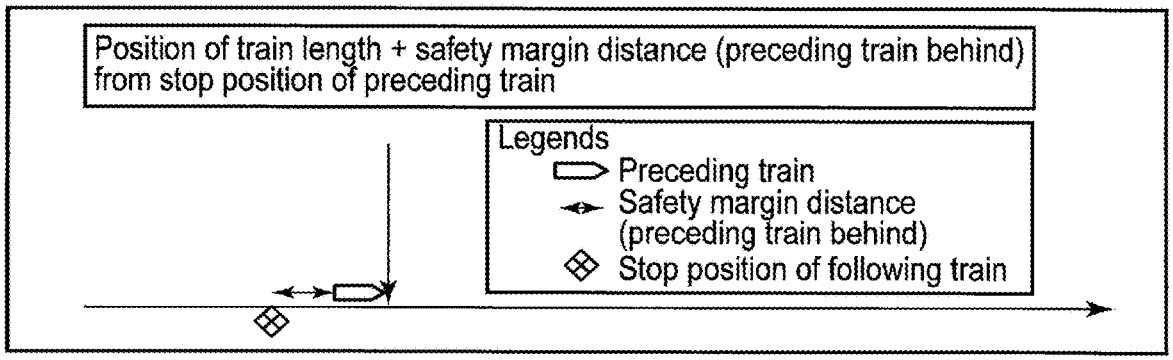
FIG. 19 is a diagram showing a calculation end position in a case where the headway pattern is "departure/arrival" in the moving block signaling headway calculation system according to the embodiment.

FIG. 19 shows a calculation end position in a case where the headway pattern is "departure/arrival". When the headway pattern is "departure/arrival", the headway value calculation end position is defined as a position corresponding to the sum of train length and safety margin distance (preceding train behind) from the preceding train stop position.

As described above, if the headway calculation start position and calculation end position are determined, then the moving block signaling headway calculation processor 11 performs a total calculation (calculation at a calculation point set for every calculation distance interval) at calculation distance intervals (computation granularity).

In the moving block signaling headway calculation in the moving block signaling headway calculation system 100, in accordance with the set calculation distance interval (computation granularity), a calculation point is set with the granularity, and headway calculation is performed at every calculation points. Then, in only a section where headway should be calculated minutely, the headway is finely calculated step by step to the limit of granularity with which the section can be subdivided.

Figure 20:
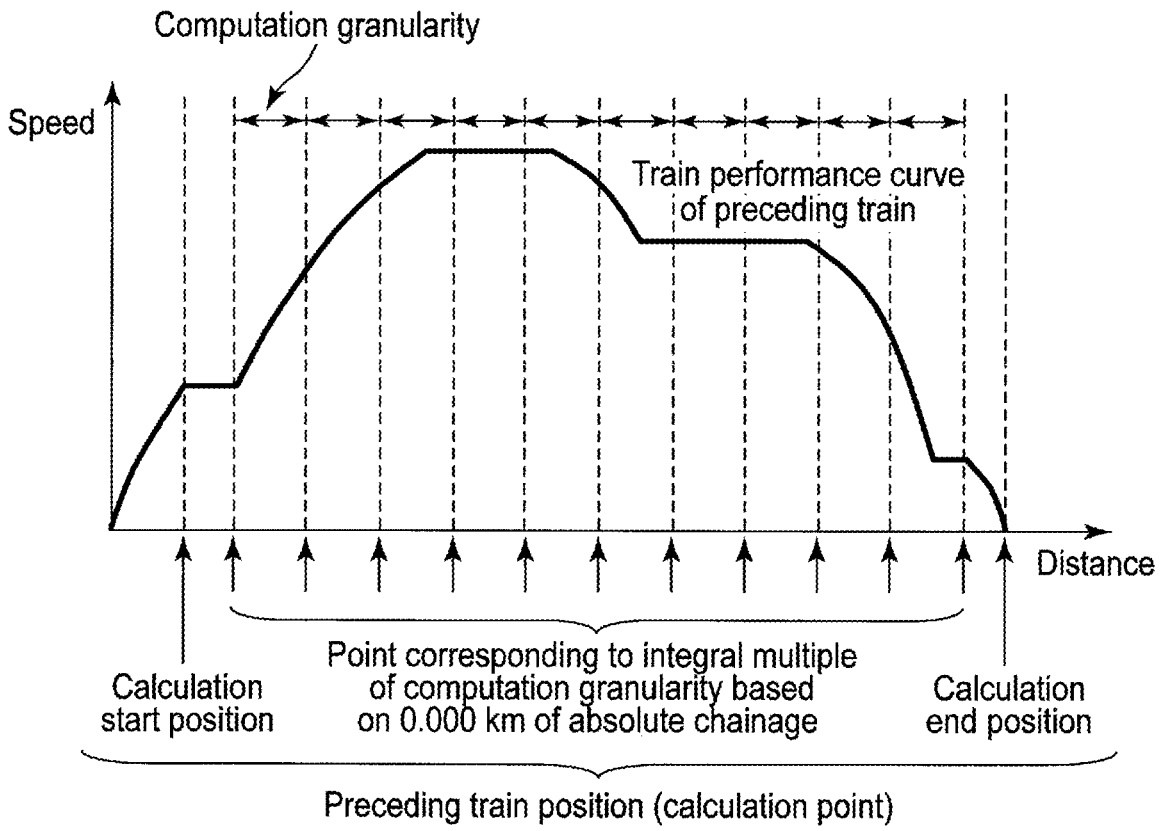
FIG. 20 is a diagram showing absolute chainage and calculation distance interval in moving block signaling headway calculation in the moving block signaling headway calculation system according to the embodiment.

In the moving block signaling headway calculation in the moving block signaling headway calculation system 100, for example, it is assumed that a calculation point is set at each of the calculation start point and calculation end point, and between the points, as shown in FIG. 20, a calculation point is set in a position that is an integral multiple of the computation granularity based upon 0.000 km of the absolute chainage.

For example, when the calculation start point is 11.475 km, the calculation end point is 12.105 km and the computation granularity is 100 m, a calculation point is set at each of the points of 11.475 km, 11.500 km, 11.600 km, 11.700 km, 11.800 km, 11.900 km, 12.000 km, 12.100 km and 12.105 km.

Below is a description of calculation of the backward-calculated braking curve.

Figure 21:
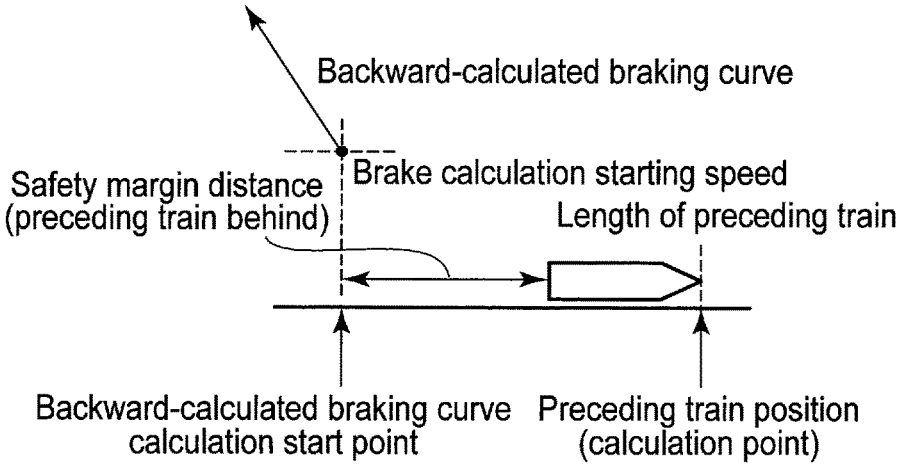
FIG. 21 is a diagram showing a relationship between a preceding train and a starting point of a brake in the moving block signaling headway calculation system according to the embodiment.

FIG. 21 is a diagram showing a relationship between a preceding train and a starting point of a brake.

In the moving block signaling headway calculation in the moving block signaling headway calculation system 100, as shown in FIG. 21, a point on the starting station side located away from the position of a preceding train by the sum of the length of the preceding train and the safety margin distance (preceding train behind) is defined as a starting point where the brake is stopped or the speed which is considered to be stopped by brake. The speed which is regarded as stopped by the brake is started is defined as a brake calculation starting speed.

Figure 22:
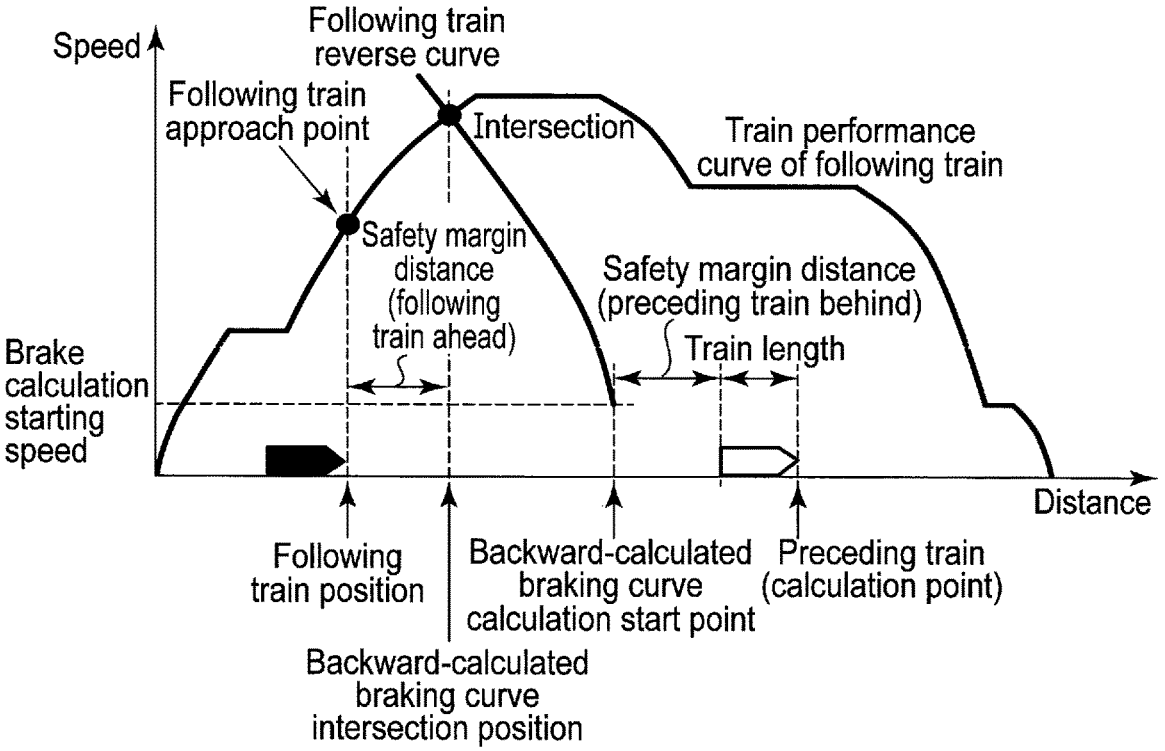
FIG. 22 is a diagram illustrating how to obtain an approach point of a following train in the moving block signaling headway calculation system according to the embodiment.

The moving block signaling headway calculation processor 11 prepares a backward-calculated braking curve for each preceding train position (calculation start point) and, as shown in FIG. 22, obtains an intersection of the backward-calculated braking curve and the train performance curve of the following train. A point on the chainage train performance curve on the starting station side located away from the safety margin distance (following train ahead) from the intersection of the backward-calculated braking curve and the train performance curve of the following train, is defined as an approach point.

Figure 23:
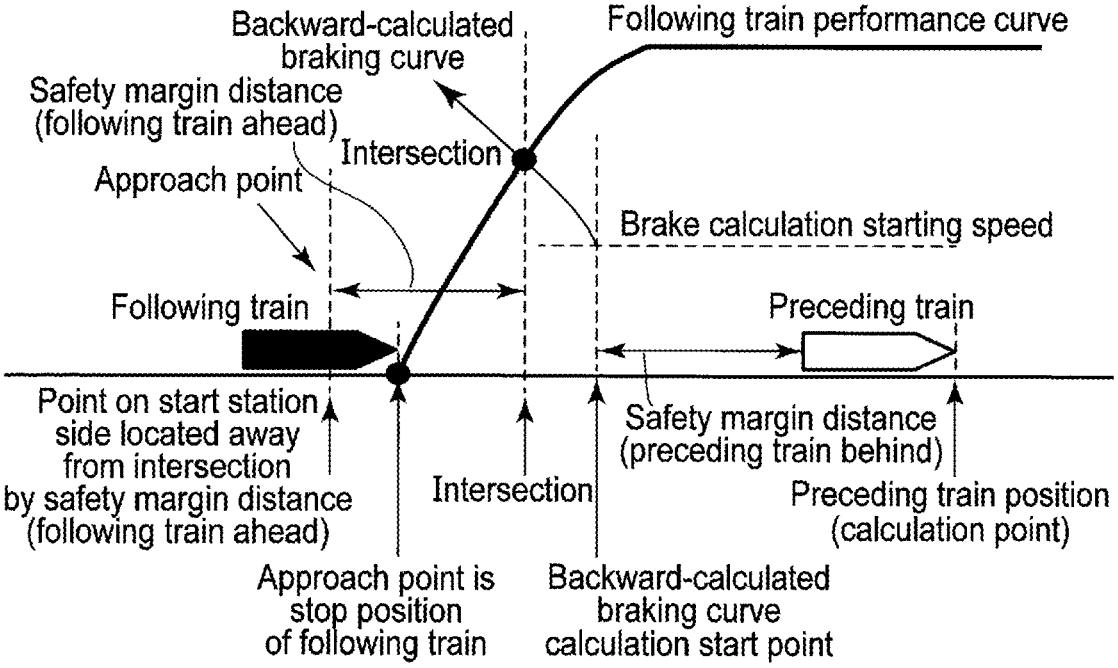
FIG. 23 is a diagram showing a first specific example of the way to obtain an approach point of a following train in the moving block signaling headway calculation system according to the embodiment.

As shown in FIG. 23, when a position on the starting station side located away from the intersection of the backward-calculated braking curve and the train performance curve of the following train by the safety margin distance (following train ahead) of chainage exceeds the starting point of the following train, the moving block signaling headway calculation processor 11 defines the starting point of the following train as an approach point. In this case, driver handling time is added to time added when the headway is calculated.

Figure 24:
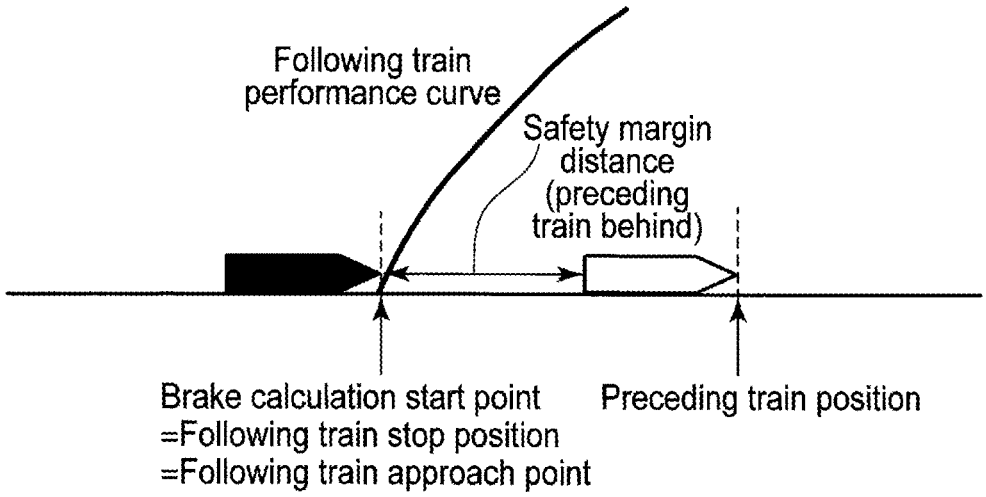
FIG. 24 is a diagram showing a calculation start point when a following train stops through the same route, which is determined in the moving block signaling headway calculation system according to the embodiment.

As shown in FIG. 24, when a preceding train and its following train run through the same route, and the following train stops at a calculation start point, the moving block signaling headway calculation processor 11 defines the brake calculation start point as a following train stop position. In this case, the brake is not started. The safety margin distance (following train ahead) that is a safety margin distance on the following train side is not taken into consideration, and the approach point of the following train is defined as a following train stop position (the safety margin distance (following train ahead) is not included because the following train stops and no error position needs to be taken into consideration). Driver handling time is also added to time added when the headway is calculated.

Figure 25:
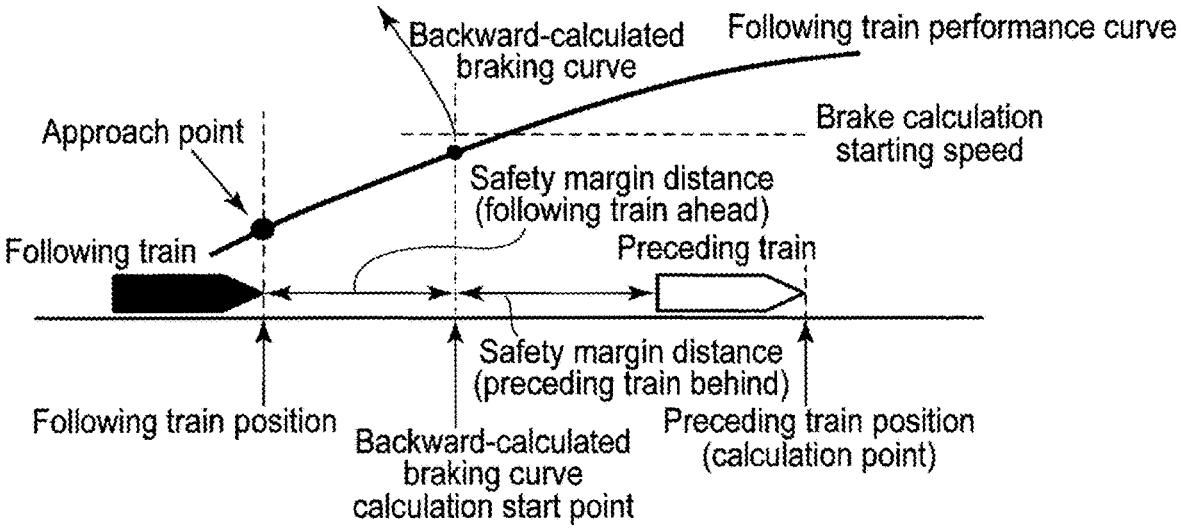
FIG. 25 is a diagram showing a second specific example of the way to obtain an approach point of a following train in the moving block signaling headway calculation system according to the embodiment.

As shown in FIG. 25, when the backward-calculated braking curve calculation start point falls within a range of the train performance curve of the following train, but the speed of the train performance curve at that point is lower than the speed at the backward-calculated braking curve calculation start point, there is no intersection of the train performance curve and the backward-calculated braking curve. In this case, the moving block signaling headway calculation processor 11 defines a point on the train performance curve on the starting station side located away from the backward-calculated braking curve calculation start point by the safety margin distance (following train ahead) as an approach point.

Figure 26:
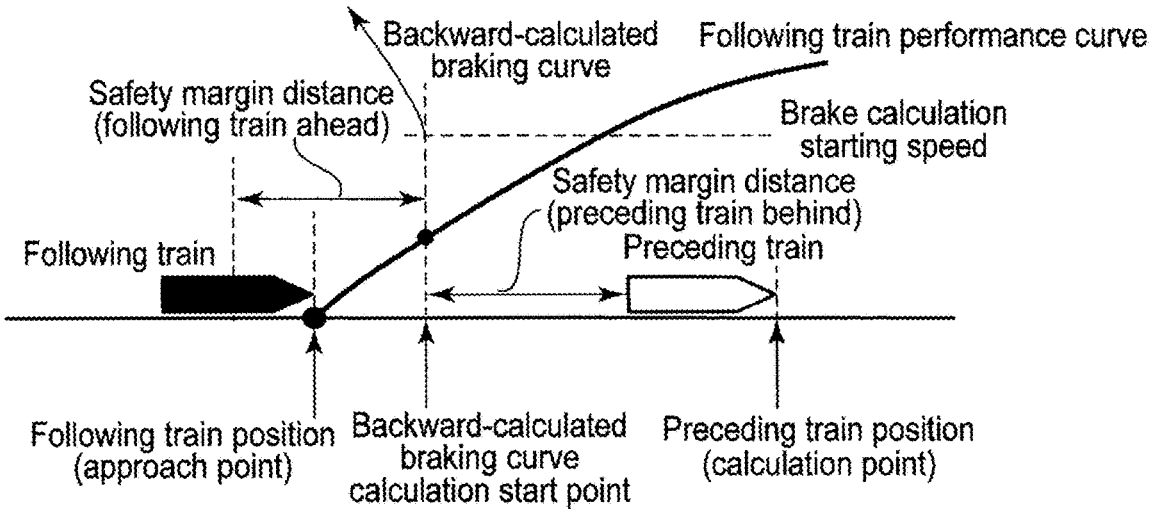
FIG. 26 is a diagram showing a third specific example of the way to obtain an approach point of a following train in the moving block signaling headway calculation system according to the embodiment.

As shown in FIG. 26, when the position of a point returned to the starting station side by the safety margin distance (following train ahead) exceeds the starting point of the following train, the moving block signaling headway calculation processor 11 defines the starting point of the following train as an approach point. In this case, driver handling time is added to time added when the headway is calculated.

The moving block signaling headway calculation processor 11 calculates the operating time of a preceding train and that of its following train from the positions of the approach points of the preceding and following trains to obtain calculation headway. The method of obtaining calculation headway is the same as that in the signal system.

Figure 27:
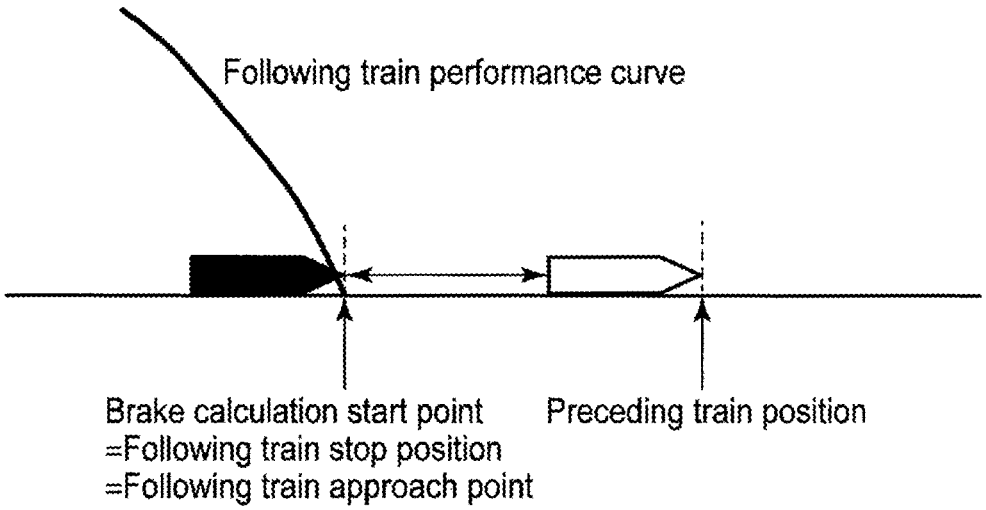
FIG. 27 is a diagram showing a calculation end point in the case of departure and arrival, which is determined in the moving block signaling headway calculation system according to the embodiment.

As shown in FIG. 27, at the calculation end point in the case of departure and arrival, a point at which the train performance curve of the following train stops at a station is defined as a brake calculation start point. In this case, the brake is not calculated, and the stop position of the following train is defined as an approach point.

Figure 28:
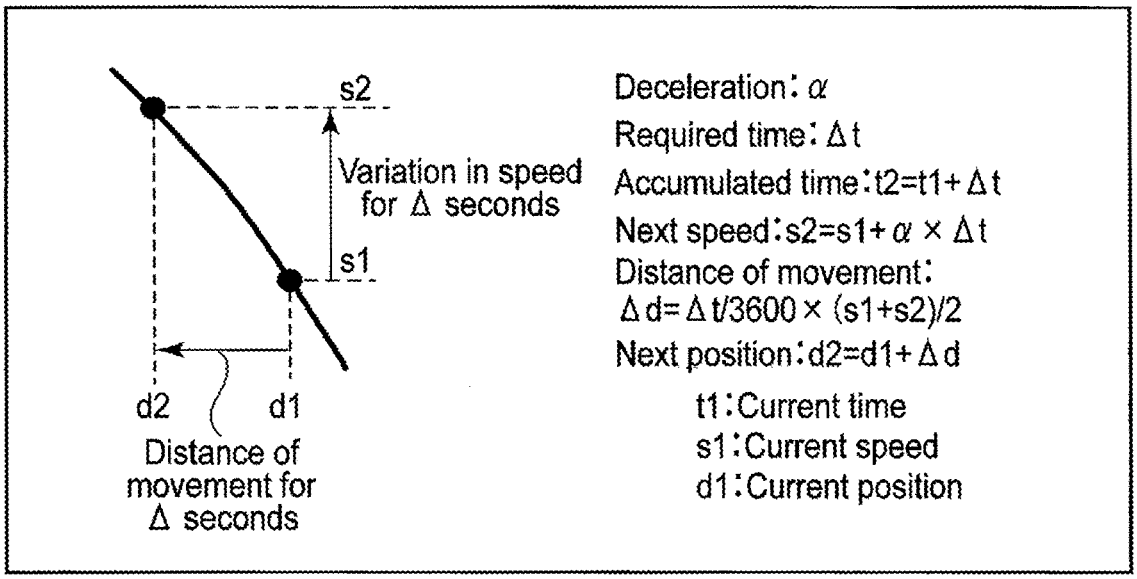
FIG. 28 is a diagram showing a method of calculating a backward-calculated braking curve in the moving block signaling headway calculation system according to the embodiment.

FIG. 28 is a diagram showing a method of calculating a backward-calculated braking curve.

In the moving block signaling headway calculation in the moving block signaling headway calculation system 100, a backward-calculated braking curve is used. The backward-calculated braking curve is calculated in a direction opposite to the running direction (calculate backward in time). This calculation processing is the same as the brake calculation processing of the train performance curve. The only difference from the previous calculations is to make the time used for calculation the past direction.

A step of obtaining acceleration $\alpha$ and distance $\Delta d$ at which a train moves in a negative direction for $\Delta t$ seconds is repeated until they intersect with the following train performance curve. The value of $\Delta t$ accumulated by the repetition when the intersection is formed is a headway value and the value of $\Delta d$ accumulated by the repetition is a brake distance.

Below are descriptions of the calculation distance interval (computation granularity) and the refinement calculation in the moving block signaling headway calculation system 100.

As the calculation distance interval (granularity) simple decreases, the amount of calculation dramatically increases. In the moving block signaling headway calculation system 100, only a portion necessary for the headway distribution is finely calculated and the other portion is not calculated. The following is a calculation method in which the amount of calculation does not increase even though apparent computation granularity increases.

The condition of railway tracks cannot vary suddenly with a distance approximate to the length of a rolling stock. Thus, the headway value does not vary greatly within a distance that is shorter than approximately 100 m. It is therefore considered that the calculation has to be performed more finely only when there may be a further peak value between headway values calculated at regular intervals.

The following four variables are necessary for refinement calculation of headway values.

(1) Calculation distance interval: 100 m (example), which is computation granularity for calculating all headway values.

(2) Resolution: 10 divisions (example), which is resolution for decrease the computation granularity by one level.

(3) Refinement granularity: 1 m (example), which means that when the resolution is 10 divisions, division may be performed two times.

(4) Headway value variation amount threshold value: five seconds (example), which is a threshold value to calculate the headway values more finely when a difference in calculated headway value between sections is larger than the value.

The headway calculation is performed through the following five steps.

(1) Calculation is performed for each calculation distance interval (computation granularity) in all sections of a calculation target to calculate a headway value.

(2) A section in which resolution should be increased further is found out in view of a list of the calculated headway values. There are two types of determination to increase the resolution, and one type of determination is targeted for a section in which the value changes from the rise and fall and the other type of determination is targeted for a second in which the value changes greatly.

(3) Calculation is more finely performed only in a target section with resolution that is decreased by one to calculate a headway value.

(4) It is determined whether calculation reaches the maximum granularity. If it reaches the maximum granularity, the calculation is terminated. If not, the step returns to (2), in which the calculation to increase the resolution is repeated.

(5) A headway distribution map is drawn from data of nonlinear continuous headway values.

A section in which resolution should be increased will be described with reference to FIG. 29, FIG. 30, FIG. 31 and FIG. 32.

Figure 29:
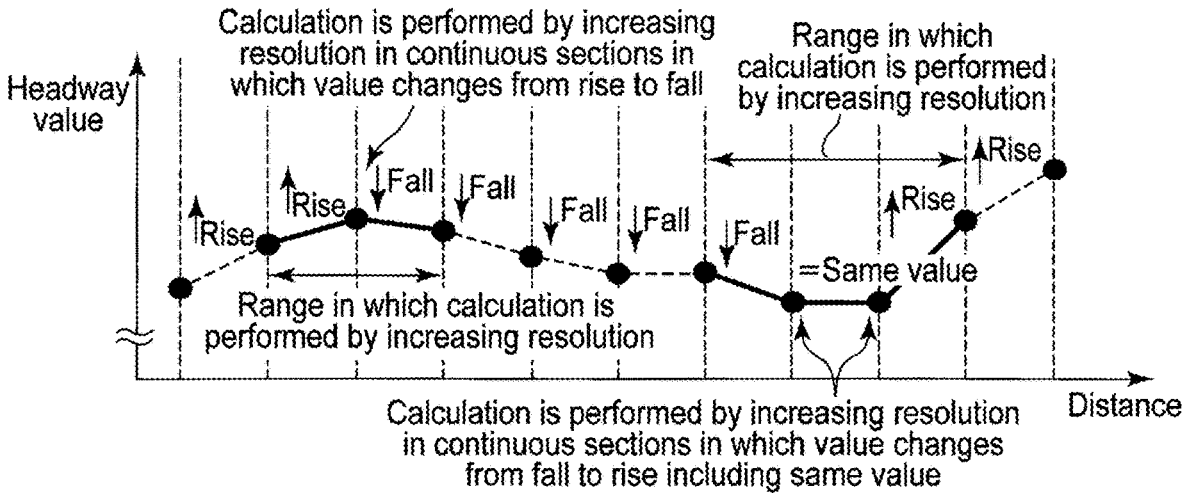
FIG. 29 is a first diagram showing a section in which resolution should be increased in the moving block signaling headway calculation system according to the embodiment.
Figure 30:
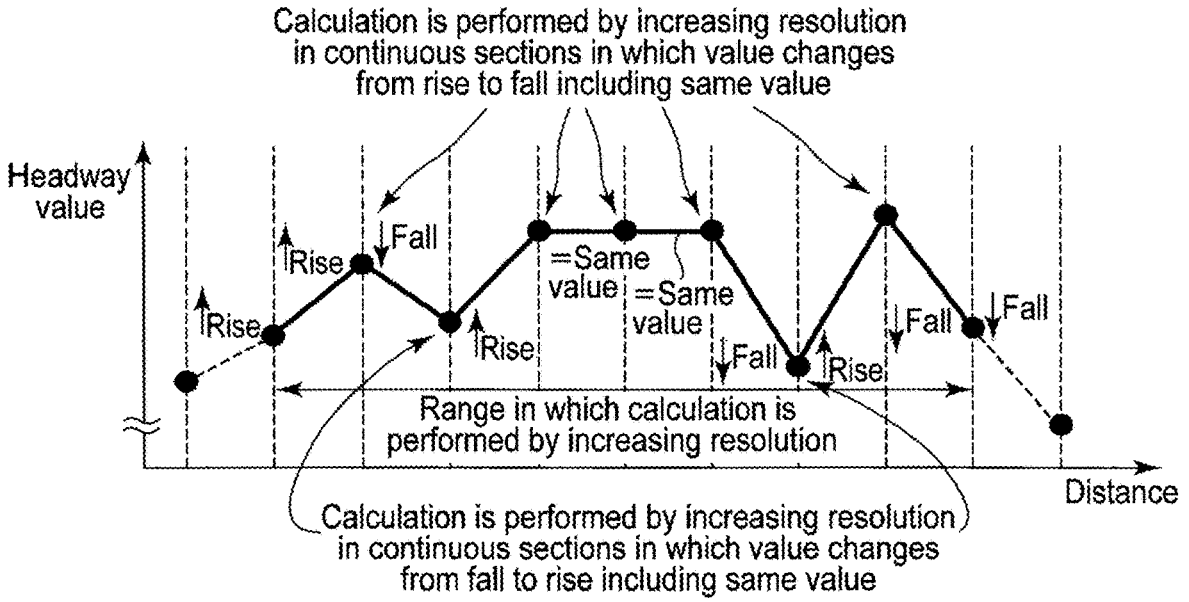
FIG. 30 is a second diagram showing a section in which resolution should be increased in the moving block signaling headway calculation system according to the embodiment.
Figure 31:
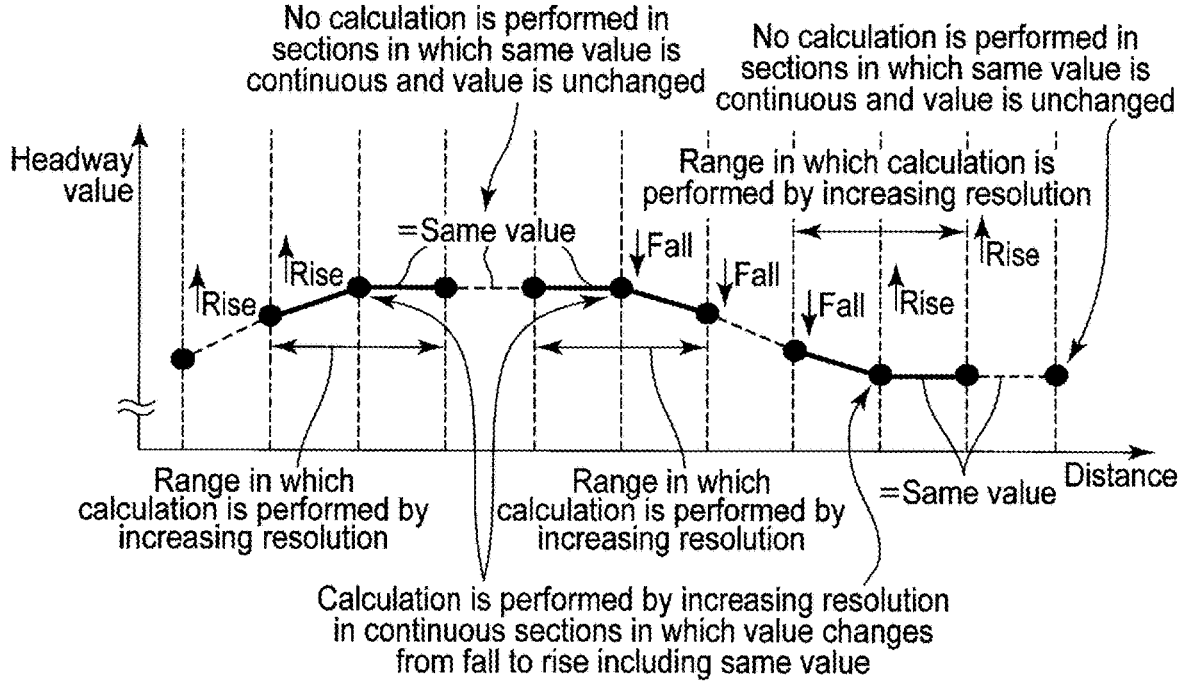
FIG. 31 is a third diagram showing a section in which resolution should be increased in the moving block signaling headway calculation system according to the embodiment.

Firstly, the moving block signaling headway calculation processor 11 defines consecutive two sections in which the calculated headway values including the same values rise and fall or fall and rise as shown in FIG. 29 and FIG. 30, as a section in which resolution is increased. Note that when the consecutive sections include the same value, the same value does not increase the resolution in those sections as shown in FIG. 31.

Figure 32:
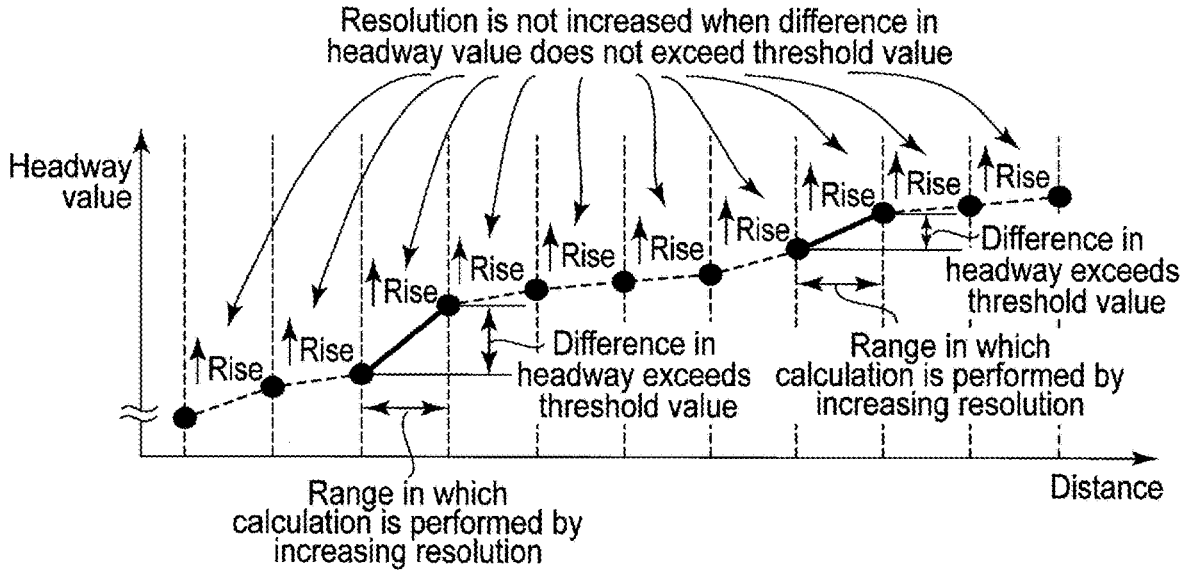
FIG. 32 is a fourth diagram showing a section in which resolution should be increased in the moving block signaling headway calculation system according to the embodiment.

Secondly, the moving block signaling headway calculation processor 11 defines a section in which a difference between the calculated headway values is large as shown in FIG. 32, as a section in which resolution is increased. The threshold value thereof is defined separately. When the difference exceeds the threshold value, the section is determined as a section in which resolution is increased.

As in the case of the total calculation performed at calculation distance intervals (computation granularity) set as a calculation condition, the moving block signaling headway calculation processor 11 performs a headway value calculation with new granularity (of the resolution that is lower by one) for the section in which resolution should be increased. Completing the calculation of the sections in which resolution should be increased, the moving block signaling headway calculation processor 11 extracts a section in which resolution should be increased further from the headway values obtained again. Then, the moving block signaling headway calculation processor 11 performs a headway value calculation with new granularity (of the resolution that is lower by another one). The moving block signaling headway calculation processor 11 repeats this refinement until it reaches the refinement granularity set as a calculation condition and performs the headway value calculation recursively.

An example of the headway value calculation performed by the moving block signaling headway calculation processor 11 will be described with reference to FIG. 33, FIG. 34, FIG. 35, FIG. 36, FIG. 37 and FIG. 38.

Assume now that the moving block signaling headway calculation processor 11 performs the calculation using the following variables.

Figures 33, 34:
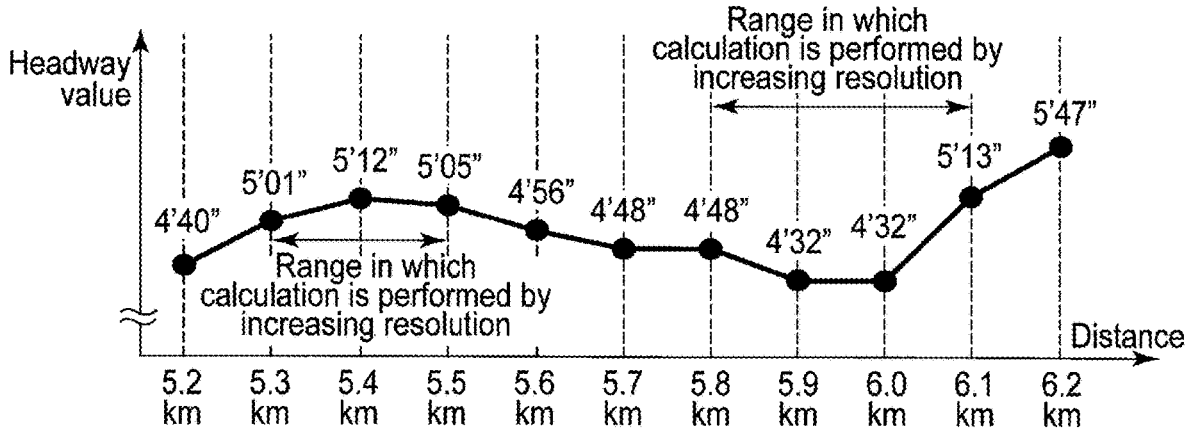
FIG. 33 is a diagram showing an example of the total calculation performed at calculation distance intervals (computation granularity) in the moving block signaling headway calculation system according to the embodiment.
FIG. 34 is a diagram showing a section in which the resolution extracted from a calculation result shown in FIG. 33 should be increased.

(1) Calculation distance interval: 100 m (2) Resolution: 10 divisions (3) Refinement granularity: 1 m (4) Headway value variation amount threshold value: 60 seconds First, the moving block signaling headway calculation processor 11 calculates headway values in units of granularity of 100 m and arranges the headway values. FIG. 33 shows an example of the total calculation performed at calculation distance intervals (computation granularity).

Then, the moving block signaling headway calculation processor 11 extracts a section in which resolution should be increased. FIG. 34 is a diagram showing a section in which the resolution extracted from the calculation result shown in FIG. 33 should be increased. As shown in FIG. 34, the moving block signaling headway calculation processor 11 extracts sections of 5.3 km through 5.5 km and sections of 5.8 km through 6.1 km as consecutive sections in which the headway values change from rise to fall or from fall to rise.

The moving block signaling headway calculation processor 11 increases the resolution only for the extracted sections, calculates headway values in units of granularity of 10 m, and arranges the headway values. FIG. 35 shows an example of headway calculation in a section in which resolution should be increased. In FIG. 35, (A) indicates an example of headway calculation in sections of 5.3 km through 5.5 km, and (B) indicates an example of headway calculation in sections of 5.8 km through 6.1 km.

Figure 36:
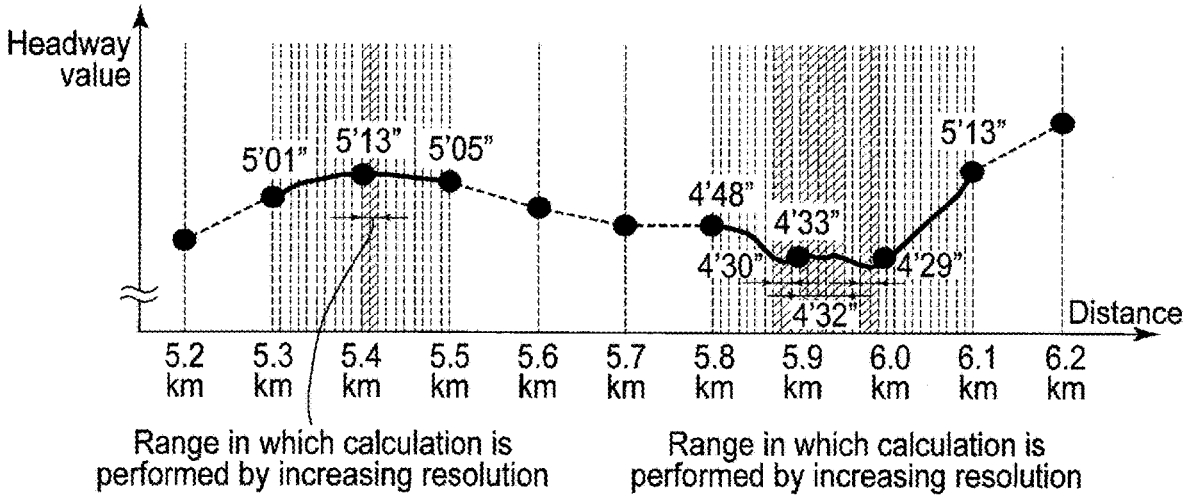
FIG. 36 is a diagram showing a section in which the resolution extracted from a calculation result shown in FIG. 35 should be increased.

The moving block signaling headway calculation processor 11 extracts a section in which resolution should be increased further from the sections in which resolution is increased to calculate headway values. FIG. 36 is a diagram showing a section in which the resolution extracted from a calculation result shown in FIG. 35 should be increased. As shown in FIG. 36, the moving block signaling headway calculation processor 11 extracts sections of 5.40 km through 5.42 km, sections of 5.87 km through 5.89 km, sections of 5.90 km through 5.95 km, and sections of 5.97 km through 5.99 km as consecutive sections in which the headway values change from rise to fall or from fall to rise.

The moving block signaling headway calculation processor 11 increases the resolution only for the extracted sections, calculates headway values in units of granularity of 1 m, and arranges the headway values. FIG. 37 shows an example of headway calculation in a section in which resolution should be increased. In FIG. 37, (A) indicates an example of headway calculation in sections of 5.40 km through 5.42 km, (B) indicates an example of headway calculation in sections of 5.87 km through 5.89 km, (C) indicates an example of headway calculation in sections of 5.87 km through 5.89 km, and (D) indicates an example of headway calculation in sections of 5.97 km through 5.99 km.

Since the refinement granularity is assumed to be 1 m, the moving block signaling headway calculation processor 11 terminates the headway calculation. The moving block signaling headway calculation processor 11 first calculates a headway value for each of the set calculation distance intervals with respect to the sections from the calculation start position to the calculation end position determined as described above and based on a result of the headway value calculation, extracts sections in which resolution should be increased, and decreases the computation granularity by one step with the set resolution. Then, the moving block signaling headway calculation processor 11 repeats the extraction of sections in which resolution should be increased and the refinement of the computation granularity until they reach the set refinement granularity.

FIG. 38 shows an example of all headway values calculated by the moving block signaling headway calculation processor 11. As shown in FIG. 38, the moving block signaling headway calculation processor 11 creates a list of nonlinear continuous headway values that differ in computation granularity. In other words, as a result, the moving block signaling headway calculation processor 11 generates the headway value data 38 in which distance intervals are not constant.

The headway distribution curve display processor 12 reads a following train performance curve, which is included in the train performance curves that are distance-speed curves based on which headway calculation is performed, and the headway values and brake distance data, which are calculated and stored by the moving block signaling headway calculation processor 11, from the storage device 30, and displays a headway distribution curve (a headway value to the preceding train position chainage) on the display device 40 together with, e.g., the train performance curve and brake distance curve (a brake distance to the preceding train position chainage) of the following train.

Figure 39:
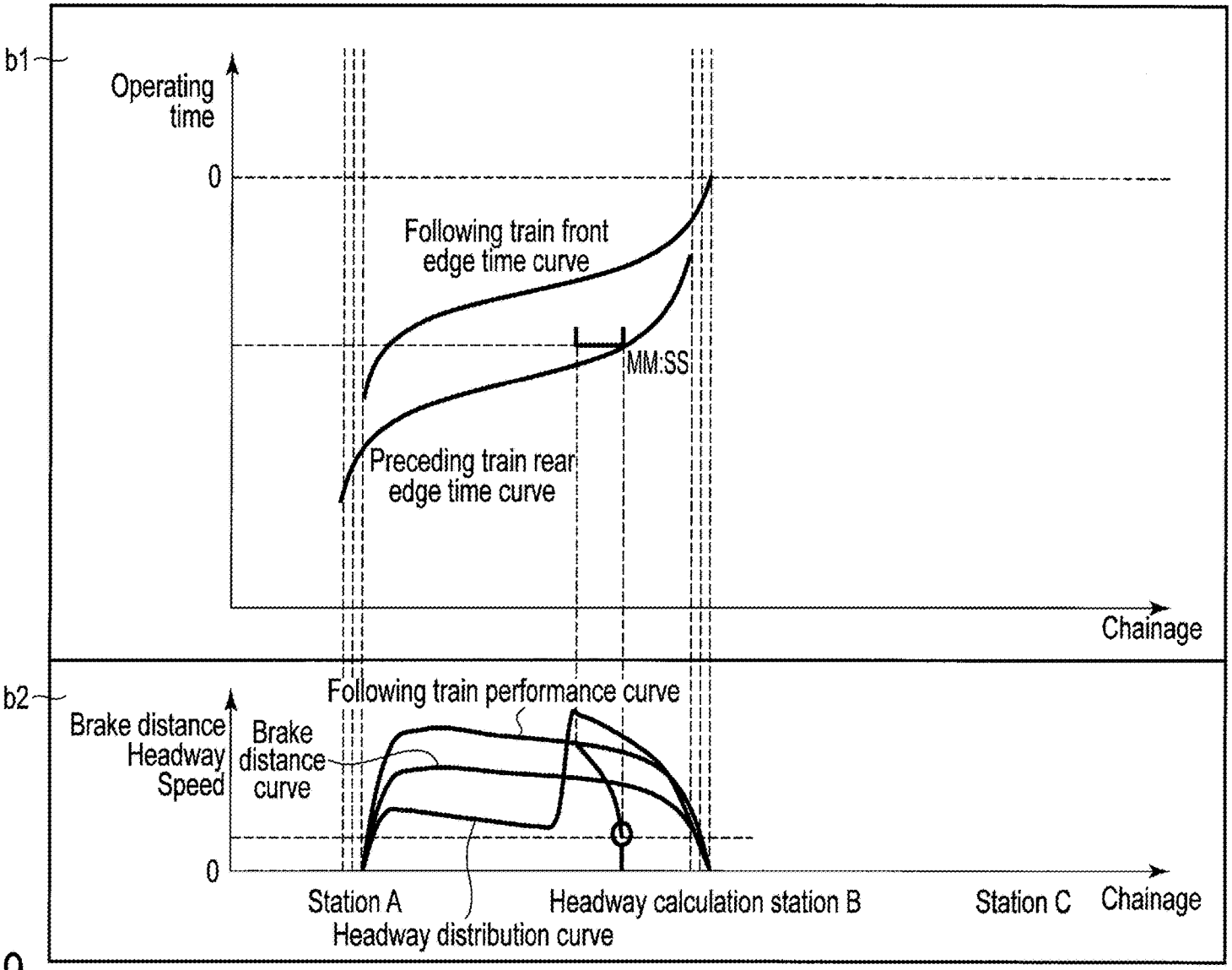
FIG. 39 is a diagram showing an example of screen display of the train performance curve, headway distribution curve and brake distance curve of the following train in the moving block signaling headway calculation system according to the embodiment.

FIG. 39 shows an example of screen display of the train performance curve, headway distribution curve and brake distance curve of a following train. In FIG. 39, the area indicated by symbol b2 is a display area of the train performance curve, headway distribution curve and brake distance curve of the following train. Though the distance intervals are not constant, the headway distribution curve display processor 12 connects a headway value and a brake distance value by a line in correspondence with the distance to generate a curve where the horizontal axis and the vertical axis indicate, for example, distance and time, respectively.

The headway distribution curve display processor 12 may also display the time curve of the rear edge of the preceding train and that of the front of the following train on the screen, together with the train performance curve, headway distribution curve and brake distance curve of the following train. In FIG. 39, the area indicated by symbol b1 is a display area of the time curve of the rear edge of the preceding train and that of the front edge of the following train.

In the time curve that is a distance-time curve of the train performance curve, time when the front edge of the following train reaches a headway calculation station is 0 or time when the front edge of the following train starts from the headway calculation station is 0. The headway distribution curve display processor 12 draws a time curve in such a manner that when the maximum value of the calculated headway values is defined as a maximum headway value, the rear edge of the preceding train reaches the headway calculation station at the time shifted by the maximum headway value or the rear edge of the preceding train starts from the headway calculation station.

Figure 40:
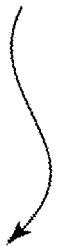
FIG. 40 is a diagram showing an example of screen display of a list of headway values in the moving block signaling headway calculation system according to the embodiment.

As shown in FIG. 40, the headway distribution curve display processor 12 can achieve a screen capable of displaying a list of desired headway values. The headway distribution curve display processor 12 can display preceding train chainage that is a distance position used for the backward-calculated braking curve calculation, following train chainage in which a safety margin distance is considered in the chainage of an intersection of a following train performance curve and a backward-calculated braking curve, a brake distance, a preceding train position in which a train length from the preceding train chainage, etc., is considered, preceding train time that is time on the preceding train time curve at the preceding train chainage, following train time that is time on the following train time curve at the preceding train chainage, a calculation headway value that is a desired headway value, a signal headway value in which processing time and transmission delay of a signal are considered, and the like.

Figure 41:
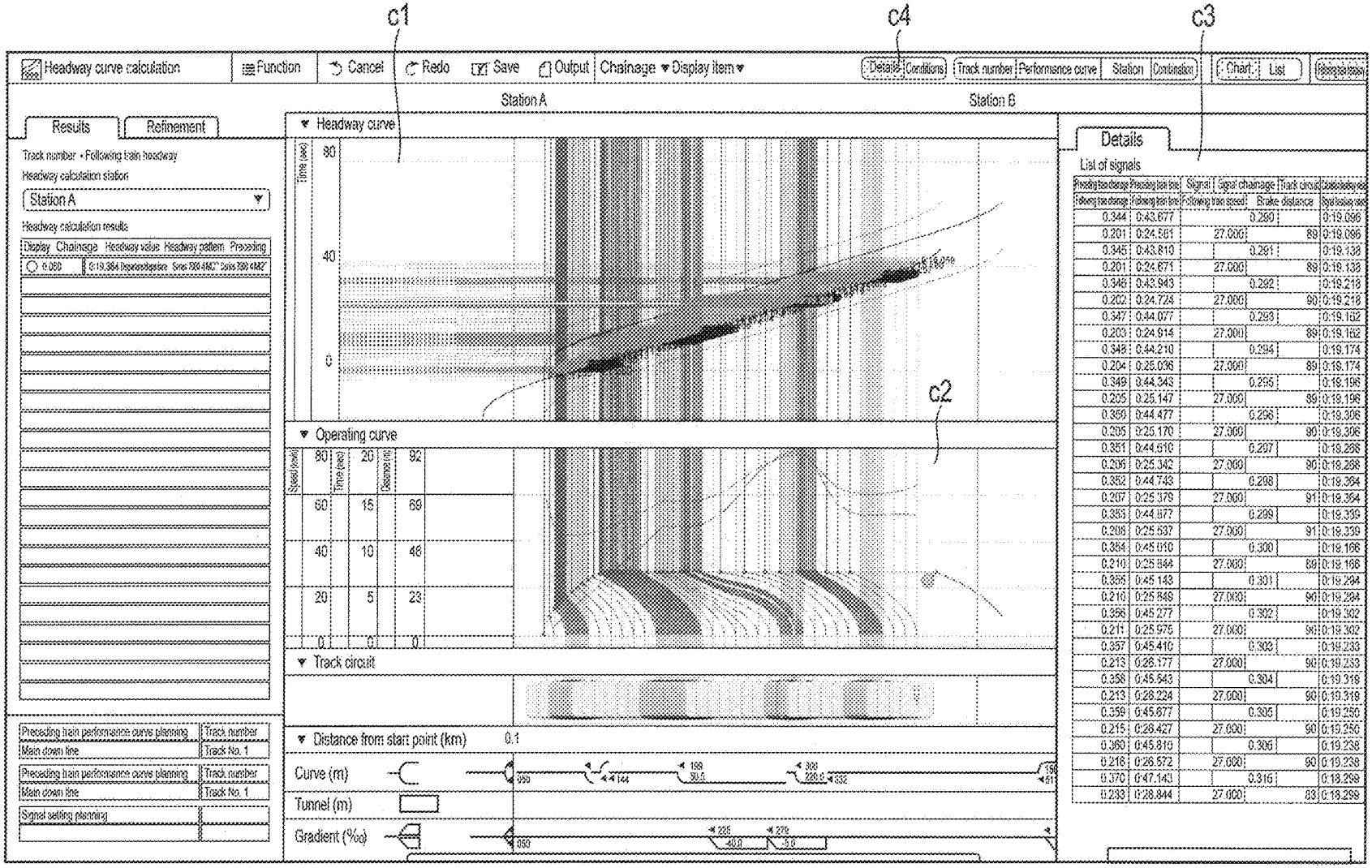
FIG. 41 is a diagram showing an example of simultaneous screen display of a headway distribution curve, a train performance curve and a list of headway values in the moving block signaling headway calculation system according to the embodiment.

The headway distribution curve display processor 12 can also display a headway distribution curve, a train performance curve and a list of headway values simultaneously. FIG. 41 shows an example of displaying a headway distribution curve, a train performance curve and a list of headway values on the same screen. In FIG. 41, the area indicated by symbol c1 is a display area of the headway distribution curve, the area indicated by symbol c2 is a display area of the train performance curve, and the area indicated by symbol c3 is a display area of the list of headway values. During the display of, e.g., the headway distribution curve and the train performance curve, the headway distribution curve display processor 12 may display the list of headway values in addition to the headway distribution curve and the train performance curve when a predetermined button (c4) is operated.

Figure 42A:
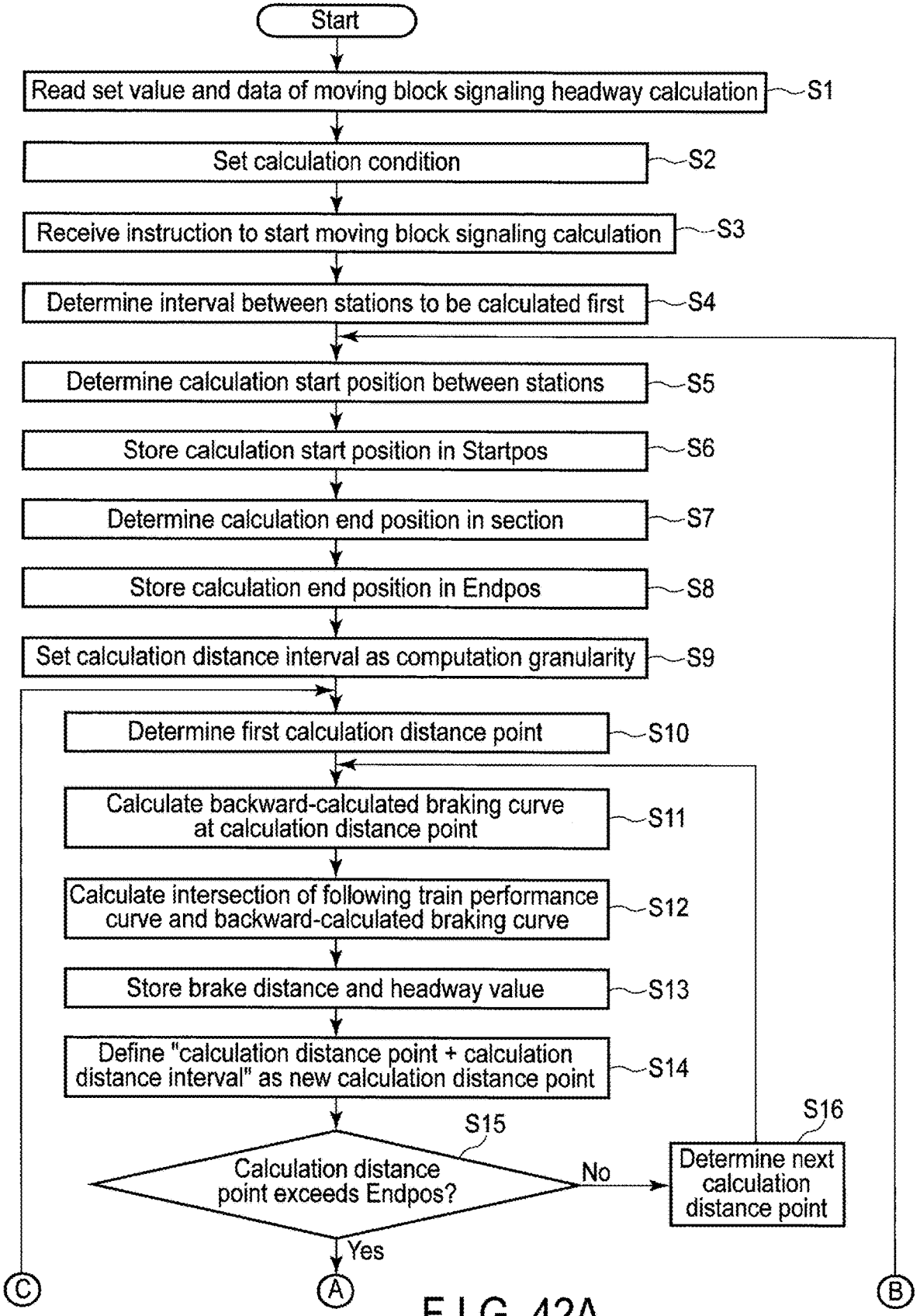
FIG. 42A is a first flowchart showing an example of a processing procedure of moving block signaling headway calculation in the moving block signaling headway calculation system according to the embodiment.
Figure 42B:
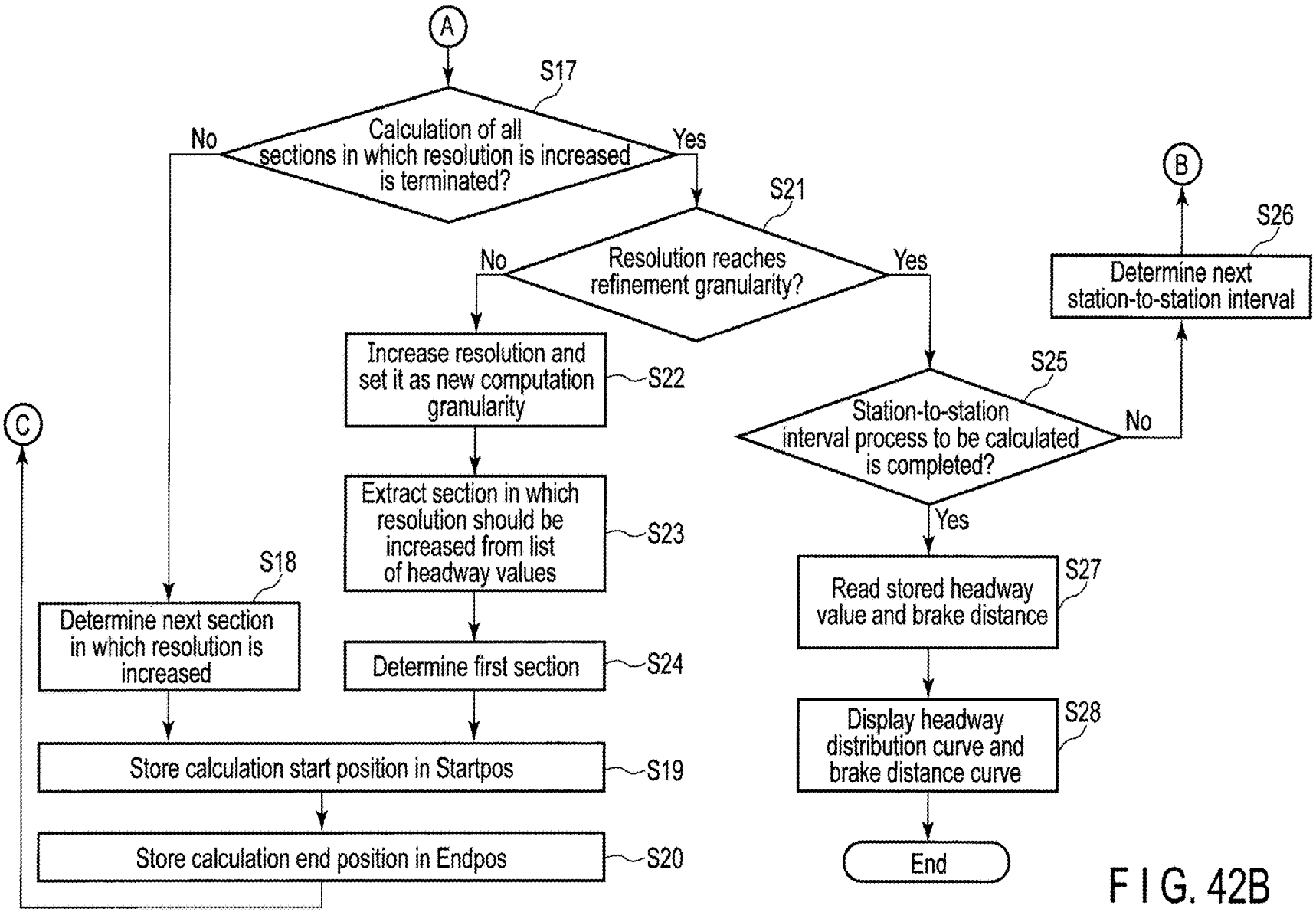
FIG. 42B is a second flowchart showing an example of the processing procedure of moving block signaling headway calculation in the moving block signaling headway calculation system according to the embodiment.

FIG. 42A and FIG. 42B are flowcharts each showing an example of a processing procedure of the moving block signaling headway calculation in the moving block signaling headway calculation system 100 according to the present embodiment.

The moving block signaling headway calculation processor 11 first reads a set value and data (variable) of the moving block signaling headway calculation (step S1). The moving block signaling headway calculation processor 11 sets calculation conditions (step S2).

The moving block signaling headway calculation processor 11 receives an instruction to start moving block signaling calculation (step S3) and determines an interval between stations to be calculated first (step S4). The moving block signaling headway calculation processor 11 determines a calculation start position between the stations (step S5) and stores the calculation start position in Startpos (variable) (step S6). Then, the moving block signaling headway calculation processor 11 determines a calculation end position in a section (step S7) and stores the calculation end position in the Endpos (variable) (step S8). The moving block signaling headway calculation processor 11 sets the calculation distance interval set in step S2 as computation granularity (step S9).

The moving block signaling headway calculation processor 11 determines a first calculation distance point (step S10) and calculates a backward-calculated braking curve at the calculation distance point (step S11). The moving block signaling headway calculation processor 11 calculates an intersection of the following train performance curve and the backward-calculated braking curve (step S12) and stores a brake distance and a headway value (step S13).

The moving block signaling headway calculation processor 11 defines a point separated from the calculation distance point by the calculation distance interval as a calculation distance point (step S14) and determines whether or not the calculation distance point exceeds the Endpos (step S15). When the calculation distance point does not exceed the Endpos (No in step S15), the moving block signaling headway calculation processor 11 determines a next calculation distance point (step S16) and returns to step S11.

When the calculation distance point exceeds the Endpos (Yes in step S16), the moving block signaling headway calculation processor 11 determines whether or not all sections in which the resolution is increased are calculated (step S17). When the calculation is not terminated (No in step S17), the moving block signaling headway calculation processor 11 determines a next section in which the resolution is increased (step S18), stores the calculation start position in the Startpos (variable) (step S19), and stores the calculation end position in the Endpos (variable) (step S20). Then, the moving block signaling headway calculation processor 11 returns to step S10.

When the calculation of all sections is terminated (Yes in step S17), the moving block signaling headway calculation processor 11 determines whether or not the resolution reaches the refinement granularity set in step S2 (step S21). When the resolution does not reach the refinement granularity (No in step S21), the moving block signaling headway calculation processor 11 increases the resolution and sets it as new computation granularity (step S22). The moving block signaling headway calculation processor 11 extracts a section in which the resolution should be increased from the list of headway values (step S23) and determines a first section (step S24). The moving block signaling headway calculation processor 11 stores the calculation start position in the Startpos (variable) (step S19), stores the calculation end position in the Endpos (variable) (step S20), and returns to step S10.

When the resolution reaches the refinement granularity (Yes in step S21), the moving block signaling headway calculation processor 11 determines whether or not a station-to-station interval process to be calculated is completed (step S25). When it is not completed (No in step S25), the moving block signaling headway calculation processor 11 determines a next station-to-station interval (step S26) and returns to step S25. When it is completed (Yes in step S25), the headway distribution curve display processor 12 reads the stored headway value and brake distance (step S27), and displays the headway distribution curve and brake distance curve (step S28).

To grasp a variation in headway values distributed between stations and a variation in brake distance correctly, headway needs to be calculated at regular intervals between the stations. To obtain a more correct distribution, the regular intervals need to be subdivided. Since, however, it is only the peak value that is necessary for the headway calculation, a section corresponding to the peak value has to be finely calculated. Paying attention to this point, the moving block signaling headway calculation system 100 according to the present embodiment narrows a section in which a headway value should be calculated and suppresses the amount of calculation to calculate only necessary data at high speed.

That is, the moving block signaling headway calculation system 100 according to the present embodiment can obtain a high-accuracy headway distribution curve at a small amount of calculation.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A moving block signaling headway calculation system that calculates a headway value in a running section of a train whose operation is controlled irrespective of blockage, the system comprising:

a processor; and a memory electrically coupled to the processor and configured to store instructions executable by the processor, wherein the processor is configured to:

acquire calculation distance interval data, refinement granularity data and headway value variation amount threshold value data, the calculation distance interval data representing a reference value of an interval between points at which a headway value is to be calculated, the refinement granularity data representing a limit value with which the interval is allowed to be subdivided, the headway value variation amount threshold value data representing a threshold value of an amount of variation in headway value between adjacent two points; and obtain a headway value distribution curve in the running section by:

setting the reference value represented by the calculation distance interval data to the interval as an initial value; and recursively executing a process until the interval reaches a limit value indicated by the refinement granularity data, the process including;

calculating headway values for a plurality of points on the running section for each interval;

extracting a section between the adjacent two points, in which an amount of variation in the headway values between the adjacent two points exceeds the threshold value represented by the headway value variation amount threshold value data, a section between the adjacent two points before and after a front point and an end point of a point or a section where a headway value changes from rise to fall, or a section between the adjacent two points before and after a front point and an end point of a point or a section where a headway value changes from fall to rise; and subdividing the interval in the extracted sections to calculate the headway value.

2. The moving block signaling headway calculation system of claim 1, wherein the processor is further configured to input a calculation condition of headway value by presenting a screen to set the calculation condition, the calculation condition including the calculation distance interval data, the refinement granularity data, and the headway value variation amount threshold value data.

3. The moving block signaling headway calculation system of claim 1, wherein the processor is further configured to present a screen on which a headway value distribution curve of the running section is placed, the headway value distribution curve being obtained from the headway values calculated by the headway value calculator and being placed on the screen while a first axis represents a distance and a second axis represents orthogonal to the first axis represents time.

4. The moving block signaling headway calculation system of claim 3, wherein the processor is further configured to place a list of headway values on the screen together with the headway value distribution curve, the headway values being calculated at different intervals within the running section by the headway value calculator.

5. The moving block signaling headway calculation system of claim 4, wherein the processor is further configured to place a train performance curve of the running section on the screen together with the headway value distribution curve and the list of headway values, the train performance curve being placed on the screen while the first axis represents a distance and the second axis represents a speed.

* * * * *